US010322580B2

(12) United States Patent
Makiguchi et al.

(10) Patent No.: US 10,322,580 B2
(45) Date of Patent: Jun. 18, 2019

(54) FRAME, CARTRIDGE, IMAGE FORMING APPARATUS, AND METHOD FOR MANUFACTURING FRAME

(71) Applicant: CANON KABUSHIKI KAISHA, Tokyo (JP)

(72) Inventors: Daisuke Makiguchi, Izunokuni (JP); Naoki Matsumaru, Suntou-gun (JP); Go Torii, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/616,149

(22) Filed: Jun. 7, 2017

(65) Prior Publication Data

US 2017/0355192 A1 Dec. 14, 2017

(30) Foreign Application Priority Data

Jun. 14, 2016 (JP) ..... 2016-118265

(51) Int. Cl.

| | |
|---|---|
| ***B41J 1/16*** | (2006.01) |
| ***B41J 2/14*** | (2006.01) |
| ***B41J 2/175*** | (2006.01) |
| ***B41J 13/076*** | (2006.01) |
| ***G03G 21/18*** | (2006.01) |

(52) U.S. Cl.

CPC ..... *B41J 2/14048* (2013.01); *B41J 1/16* (2013.01); *B41J 2/14314* (2013.01); *B41J 2/14427* (2013.01); *B41J 2/17556* (2013.01); *B41J 2/17513* (2013.01); *B41J 2002/14193* (2013.01)

(58) Field of Classification Search

CPC ..... B41J 1/16; B41J 2/14314; B41J 2/17559; B41J 13/076; G03G 21/18

See application file for complete search history.

(56) References Cited

U.S. PATENT DOCUMENTS

2009/0317129 A1* 12/2009 Abe ..... G03G 15/757 399/111
2013/0272753 A1* 10/2013 Fukasawa ..... G03G 21/18 399/279

FOREIGN PATENT DOCUMENTS

JP 2013-127575 A 6/2013

* cited by examiner

*Primary Examiner* — Jason S Uhlenhake
(74) *Attorney, Agent, or Firm* — Venable LLP

(57) ABSTRACT

A first supporting member includes a first engaging portion and a second engaging portion that respectively engage with a first engaged portion and a second engaged portion that are provided in a second supporting member. The first engaging portion and the second engaging portion are configured to apply force in directions opposite to the directions in which the first engaged portion and the second engaged portion move when an opening opens.

12 Claims, 21 Drawing Sheets

FRAME, CARTRIDGE, IMAGE FORMING APPARATUS, AND METHOD FOR MANUFACTURING FRAME

BACKGROUND OF THE INVENTION

Field of the Invention

The present invention relates to a frame of a cartridge detachably attached to an apparatus body of an image forming apparatus, a cartridge, an image forming apparatus that forms an image on a recording medium, and a method for manufacturing a frame of a cartridge.

Description of the Related Art

In an image forming apparatus which uses an electrophotographic technique, first, a photosensitive drum is charged uniformly by a charging roller. Subsequently, the charged photosensitive drum is selectively exposed, whereby an electrostatic latent image is formed on the photosensitive drum. The electrostatic latent image formed on the photosensitive drum is developed by a developing apparatus as a toner image. The toner image formed on the photosensitive drum is transferred to a recording material such as a recording sheet or a plastic sheet, and the toner image transferred to the recording material is fixed to the recording material by being heated and pressurized. Moreover, the toner remaining on the photosensitive drum after the toner image on the photosensitive drum is transferred to the recording material is removed by a cleaning blade.

Generally, in such an image forming apparatus, replenishment of toner, maintenance of various process mechanisms, and the like are required. In order to facilitate toner replenishment, maintenance, and the like, a process cartridge in which process mechanisms such as a photosensitive drum, a charging roller, a developing apparatus, and a cleaning blade are integrated as a cartridge has been in practical use. Since this process cartridge is detachably attached to an apparatus body of an image forming apparatus, replacement of a process mechanism, replenishment of toner, and the like can be performed easily by replacing the process cartridge.

According to this process cartridge system, since users can perform maintenance of an image forming apparatus by themselves, it is possible to improve operability remarkably and to provide an image forming apparatus having excellent usability. Due to this, the process cartridge system is employed broadly in an image forming apparatus.

Here, rollers such as a charging roller or a developing roller are often used in an image forming apparatus. In these rollers, a rotating shaft provided in the roller is rotatably supported by being fitted to a first supporting member attached to a frame. Here, conventionally, a first supporting member formed of two different types of resin materials is known as the first supporting member. When such a first supporting member is formed, first, a second supporting member that supports the first supporting member is formed using a first type of resin material by injection molding. Subsequently, another mold different from a mold used when the second supporting member is injection-molded is brought into close contact with the second supporting member, and a second type of resin material is injected into a gap between the mold and the second supporting member. In this manner, the first supporting member formed of the second type of resin material is attached to the second supporting member formed of the first type of resin material. Moreover, when the first supporting member is formed, the first supporting member may be attached to the second supporting member by injection-molding the second supporting member using the first type of resin material according to a two-color molding method and injecting the second type of resin material continuously without releasing the mold from the second supporting member.

By forming the first supporting member according to such a method, it is possible to use a resin having a conductivity, a sliding property, and the like as the material of the first supporting member that supports the rotating shaft of a roller and to use a high-rigidity resin material as the material of the second supporting member that supports the first supporting member. In this way, it is possible to manufacture the first supporting member having a high functionality at a low cost. For example, a configuration in which a first supporting member that rotatably supports a rotating shaft of a roller is formed of a conductive resin and electric power is supplied from an apparatus body of an image forming apparatus to the roller via the first supporting member having a conductivity is known (Japanese Patent Application Publication No. 2013-127575).

However, since members formed of two types of resin materials do not have a compatibility depending on a combination of the resin materials, a close-contact property between the first and second supporting members may decrease. In order to position the first supporting member in relation to the second supporting member with high accuracy, it is necessary to correct the position of a mold in relation to the second supporting member repeatedly. Moreover, when an impact is applied in the process of transporting a process cartridge, the first supporting member may be detached from the second supporting member. Due to this, in this technique, a tapered surface inclined in relation to a surface orthogonal to the axis of the center of rotation of a developing roller is formed on the first supporting member. In this way, the supporting accuracy of the first supporting member supporting the developing roller is improved, and the first supporting member is suppressed from being detached from the second supporting member during transporting of the process cartridge.

Specifically, a circular hole is formed in the second supporting member, and the first supporting member having a columnar shape is fitted into the hole. However, with a decrease in diameter of the photosensitive drum and the developing roller in recent years, the distance between the rotating shafts of the photosensitive drum and the developing roller has decreased. Due to this, in recent years, a circular penetration portion to which a first supporting member that supports a developing roller is fitted may interfere with a circular penetration portion to which the first supporting member that supports a photosensitive drum is fitted, and it is difficult to configure the penetration portion to which the first supporting member is fitted as a circular hole. Therefore, in recent years, in the circular penetration portion to which the first supporting member that supports the developing roller is fitted, a portion that interferes with the penetration portion to which the first supporting member that supports the photosensitive drum is fitted is removed. In this way, the inner wall surface of the penetration portion to which the first supporting member that supports the developing roller is fitted is not closed but open. That is, the inner wall surface of the penetration portion to which the first supporting member is fitted is not a circumferential surface but an arc surface. With such a configuration, even when the rotating shafts of the developing roller and the photosensitive drum are at a close distance, the developing roller and the photosensitive drum are rotatably supported.

However, when the inner wall surface of the penetration portion to which the first supporting member that supports the developing roller is fitted is open, the inner wall surface of the penetration portion may be open further due to deformation or thermal contraction of the second supporting member in which the penetration portion is formed. In this way, there is a concern that the first supporting member that supports a rotating member such as the developing roller is not positioned with satisfactory accuracy in relation to the second supporting member that supports the first supporting member and that the first supporting member is detached from the second supporting member.

SUMMARY OF THE INVENTION

A frame of cartridge that is detachably attached to an apparatus to an apparatus body of an image forming apparatus according to an embodiment of the present invention is a frame of a cartridge that is detachably attached to an apparatus body of an image forming apparatus, the frame comprising:

a first supporting member that rotatably supports a rotating member; and a second supporting member that supports the first supporting member, wherein the second supporting member includes an opening that partially exposes the first supporting member, a first engaged portion, and a second engaged portion, the first supporting member is disposed to be adjacent to the second supporting member in a direction crossing an axial direction of the rotating member and supports the second supporting member, the first supporting member including a first engaging portion that engages with the first engaged portion and a second engaging portion that engages with the second engaged portion in a plane crossing the axial direction of the rotating member, the first engaging portion is configured to apply force to the first engaged portion in a direction opposite to a direction in which the first engaged portion moves when the opening opens, and the second engaging portion is configured to apply force to the second engaged portion in a direction opposite to a direction in which the second engaged portion moves when the opening opens.

A cartridge according to an embodiment of the present invention is a cartridge comprising:

the above described frame;

the rotating member; and an image bearing member on which an electrostatic latent image is formed, wherein the rotating member is a developing roller, and a developer image is formed on the image bearing member by developing the electrostatic latent image formed on the image bearing member by the rotating member.

An image forming apparatus according to an embodiment of the present invention is an image forming apparatus comprising:

the above described frame;

an image bearing member on which an electrostatic latent image is formed; and the rotating member, wherein the rotating member is a developer bearing member for bearing a developer, a developer image is formed on the image bearing member by developing the electrostatic latent image formed on the image bearing member by the developer borne on the rotating member, and an image is formed on the recording medium by transferring, to a recording medium, the developer image formed on the image bearing member.

A method for manufacturing a frame of a cartridge that is detachably attached to an apparatus body of an image forming apparatus according to an embodiment of the present invention is a method for manufacturing a frame of a cartridge that is detachably attached to an apparatus body of an image forming apparatus, the frame including a first supporting member that rotatably supports a rotating member, and a second supporting member that supports the first supporting member, the second supporting member including an opening that partially exposes the first supporting member, a first engaged portion, and a second engaged portion, the first supporting member being disposed to be adjacent to the second supporting member in a direction crossing an axial direction of the rotating member and supported by the second supporting member, the first supporting member including a first engaging portion that engages with the first engaged portion and a second engaging portion that engages with the second engaged portion in a plane crossing the axial direction of the rotating member, the first engaging portion being configured to apply force to the first engaged portion in a direction opposite to a direction in which the first engaged portion moves when the opening opens, and the second engaging portion being configured to apply force to the second engaged portion in a direction opposite to a direction in which the second engaged portion moves when the opening opens, the method comprising:

bringing a mold into contact with the second supporting member and injecting a molten resin into a space formed between the second supporting member and the mold to form the first supporting member.

A frame of a cartridge that is detachably attached to an apparatus body of an image forming apparatus according to an embodiment of the present invention is a frame of a cartridge that is detachably attached to an apparatus body of an image forming apparatus, the frame comprising:

a first supporting member having a bearing portion that rotatably supports a rotating member; and a second supporting member that supports the first supporting member, wherein in a cross-section orthogonal to an axial direction of the rotating member, the second supporting member has an opening that partially exposes a contour of the first supporting member, and is provided with the first engaged portion on one side thereof and the second engaged portion on the other side thereof in relation to a straight line that connects the center of rotation of the rotating member and a midpoint of the opening, and in the cross-section orthogonal to the axial direction of the rotating member, the first supporting member includes a first engaging portion that engages with the first engaged portion and a second engaging portion that engages with the second engaged portion, the first and second engaging portions being convex portions that protrude from the bearing portion.

Further features of the present invention will become apparent from the following description of exemplary embodiments (with reference to the attached drawings).

DESCRIPTION OF THE EMBODIMENTS

Hereinafter, a description will be given, with reference to the drawings, of embodiments of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 2:
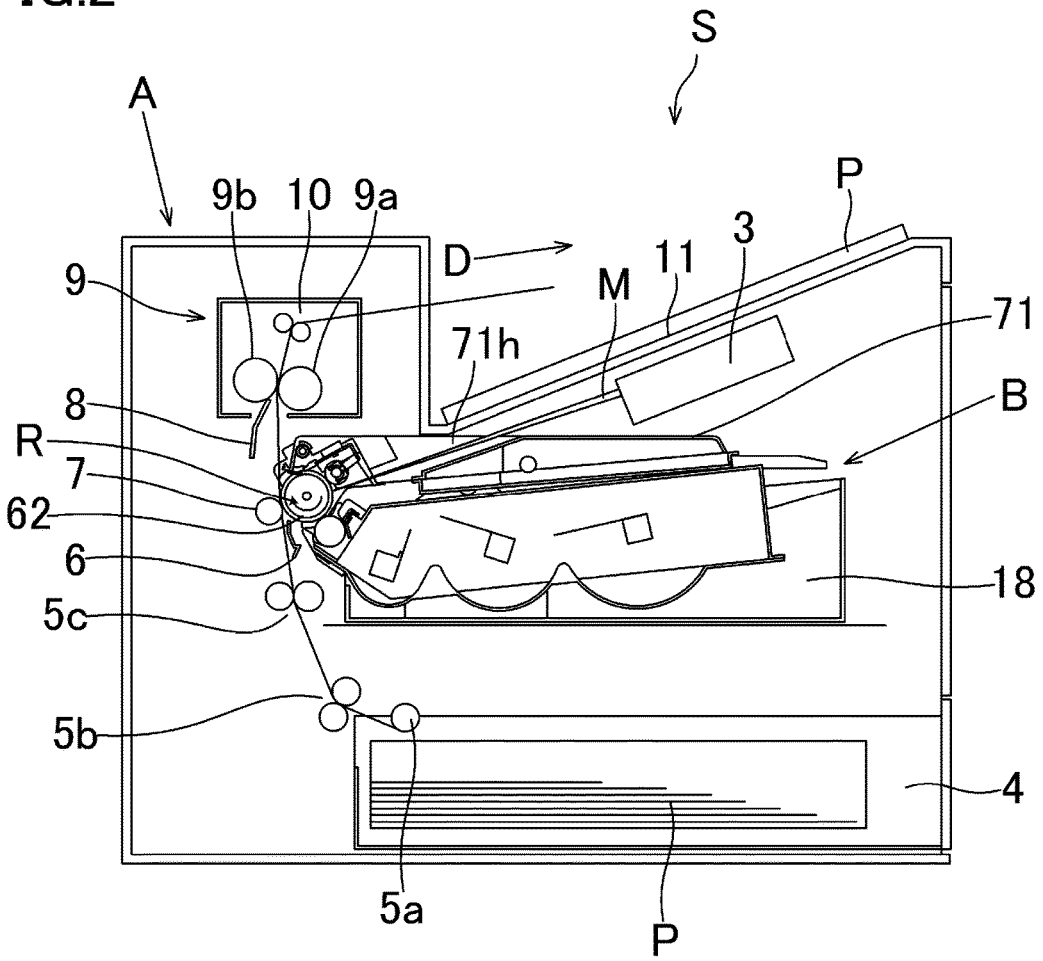
FIG. 2 is a schematic cross-sectional view illustrating an image forming apparatus according to the first embodiment.
Figure 3:
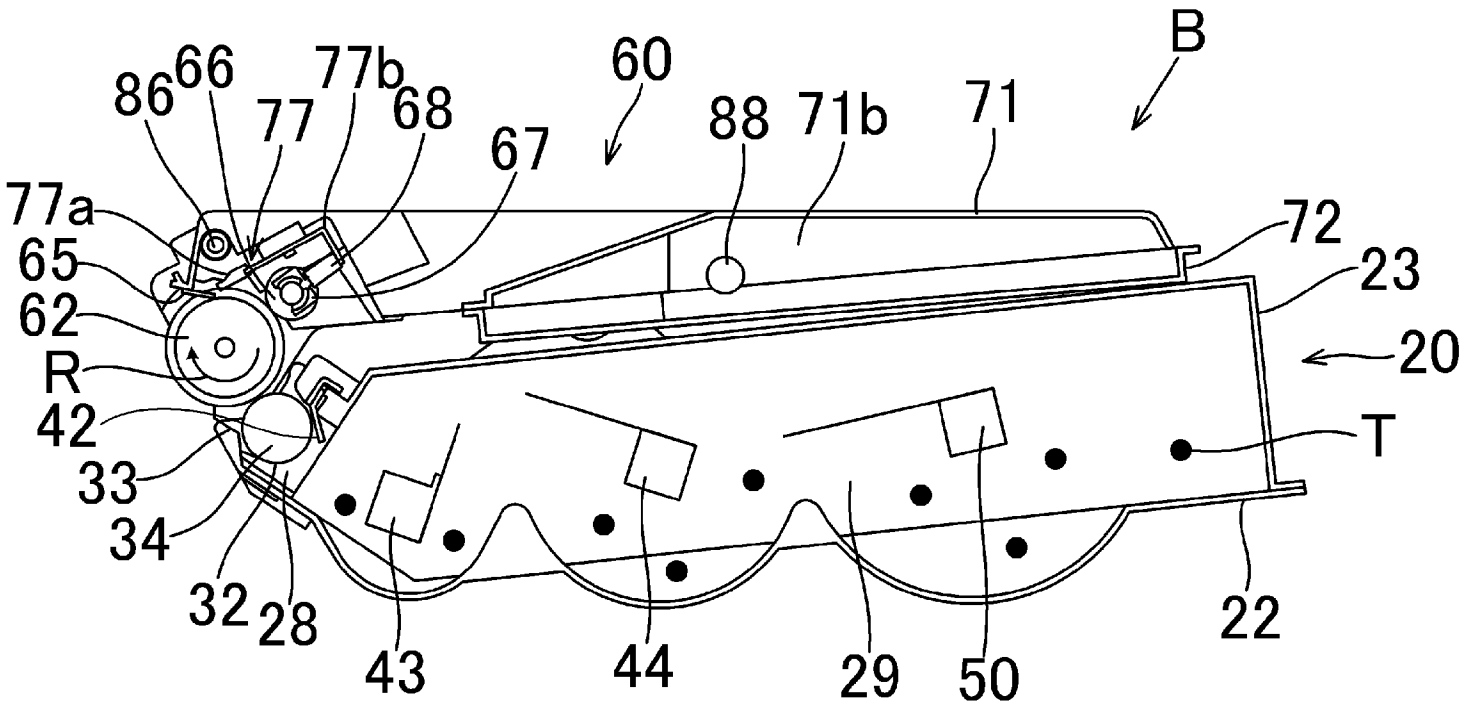
FIG. 3 is a schematic cross-sectional view of a cartridge according to the first embodiment.

Hereinafter, an embodiment will be described in detail with reference to the drawings. In the present embodiment, an axial direction of the center of rotation of an electrophotographic photosensitive drum (hereinafter referred to as a drum 62) as an image bearing member is defined as a longitudinal direction. In this longitudinal direction, a side on which the drum 62 receives driving force from an apparatus body A of an image forming apparatus S is defined as a driving side and the opposite side is defined as a non-driving side. First, an overall configuration and an image forming process of an image forming apparatus will be described with reference to FIGS. 2 and 3. FIG. 2 is a schematic cross-sectional view illustrating the image forming apparatus S according to the first embodiment. FIG. 3 is a schematic cross-sectional view of a cartridge B according to the first embodiment. Here, the apparatus body A is a portion of the image forming apparatus S excluding the cartridge B.

<Overall Configuration of Image Forming Apparatus>

The image forming apparatus S illustrated in FIG. 2 is a laser beam printer which uses an electrophotographic technique and in which the cartridge B is detachably attached to the apparatus body A. An exposure apparatus 3 (a laser scanner unit) for forming an electrostatic latent image on a drum 62 in the cartridge B is disposed in the image forming apparatus S. Moreover, a sheet tray 4 in which sheet P which is a recording medium is stored is disposed on a lower side of the cartridge B. Moreover, a pickup roller 5*a*, a feed roller pair 5*b*, a conveying roller pair 5*c*, a transfer guide 6, a transfer roller 7, a conveying guide 8, a fixing apparatus 9, a discharge roller pair 10, a discharge tray 11, and the like are sequentially disposed in the apparatus body A along a conveying direction D of the sheet P. The fixing apparatus 9 includes a heating roller 9*a* and a pressure roller 9*b*.

<Image Forming Process>

Next, an image forming process will be described. When an image forming process is executed, first, the drum 62 rotates at a predetermined circumferential velocity (a process speed) in the direction indicated by arrow R on the basis of a print start signal. Moreover, a charging roller 66 to which a bias voltage is applied makes contact with an outer circumferential surface of the drum 62 to charge the outer circumferential surface of the drum 62 uniformly. The exposure apparatus 3 outputs a laser beam M according to image information. The laser beam M passes through a laser opening 71*h* formed in a cleaning frame 71 of the cartridge B to scan and expose the outer circumferential surface of the drum 62. In this way, an electrostatic latent image corresponding to the image information is formed on the outer circumferential surface of the drum 62.

On the other hand, as illustrated in FIG. 3, in a developing unit 20 serving as a developing apparatus, toner T in a toner chamber 29 is delivered to a toner supply chamber 28 by being stirred and conveyed with rotation of a first conveying member 43, a second conveying member 44, and a third conveying member 50. The toner T is born on the surface of a developing roller 32 (corresponding to a rotating member and a developer bearing member) by magnetic force of a magnet roller (a fixed magnet). The toner T is triboelectrically charged by a developing blade 42 and the thickness of the toner T on the outer circumferential surface of the developing roller 32 is regulated. The toner T adheres to the electrostatic latent image formed on the drum 62, whereby the electrostatic latent image formed on the drum 62 is developed as a toner image serving as a developer image.

Moreover, as illustrated in FIG. 2, the sheet P as a recording medium stored in a lower portion of the apparatus body A is delivered from the sheet tray 4 by the pickup roller 5*a*, the feed roller pair 5*b*, and the conveying roller pair 5*c* in synchronization with the timing at which the laser beam M is output. The sheet P is guided to the transfer guide 6 and is conveyed to a transfer position between the drum 62 and the transfer roller 7. At this transfer position, the toner image is sequentially transferred from the drum 62 to the sheet P.

The sheet P to which the toner image is transferred is separated from the drum 62, guided by the conveying guide 8, and conveyed to the fixing apparatus 9. The sheet P passes through a nip portion between the heating roller 9*a* and the pressure roller 9*b* of the fixing apparatus 9. At this nip portion, the sheet P is pressurized and heated whereby the toner image is fixed to the sheet P. The sheet P to which the toner image is fixed is conveyed toward the discharge roller pair 10 and is discharged to the discharge tray 11 by the discharge roller pair 10.

On the other hand, as illustrated in FIG. 3, residual toner remaining on the surface of the drum 62 after the toner image is transferred to the sheet P is removed by a cleaning member 77 and is used again for an image forming process. The residual toner removed from the drum 62 is stored in the toner chamber 71*b* of a cleaning unit 60. In the above description, the charging roller 66, the developing roller 32, the transfer roller 7, the cleaning member 77, and the like are process mechanisms that act on the drum 62.

<Attachment and Detachment of Cartridge B>

Figure 5:
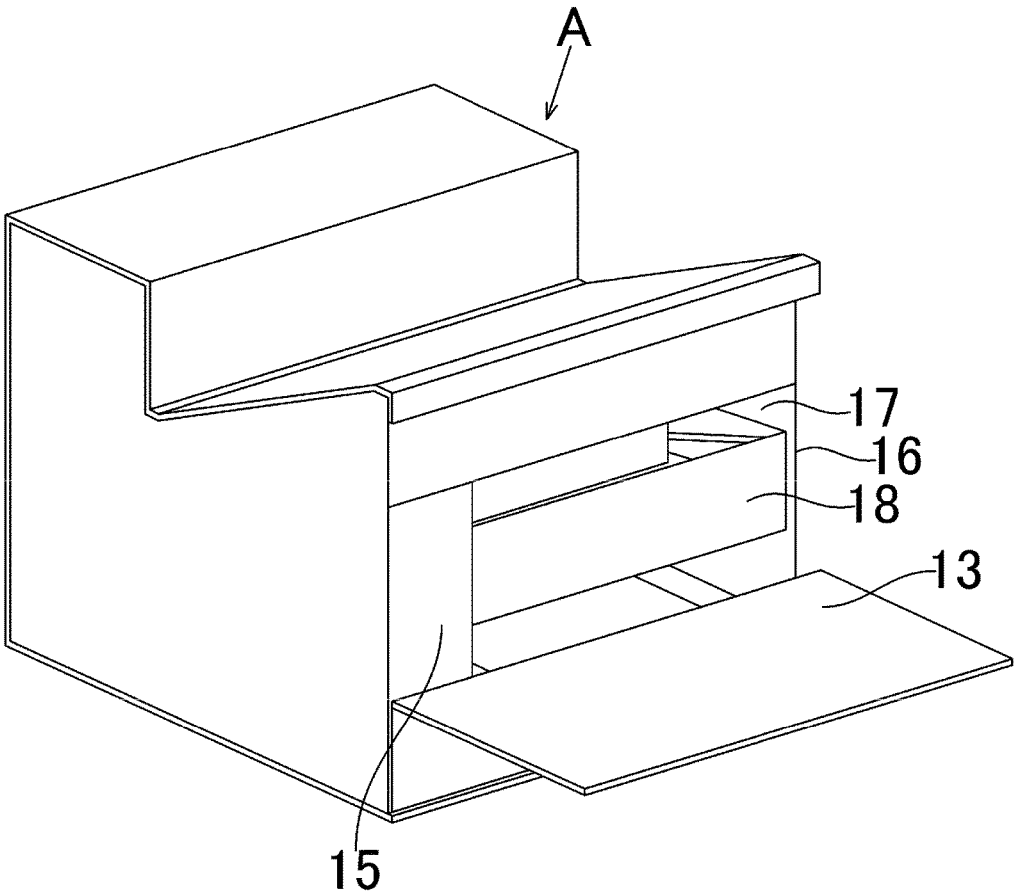
FIG. 5 is a diagram illustrating an open state of an opening door of an apparatus body of the image forming apparatus according to the first embodiment.
Figure 6:
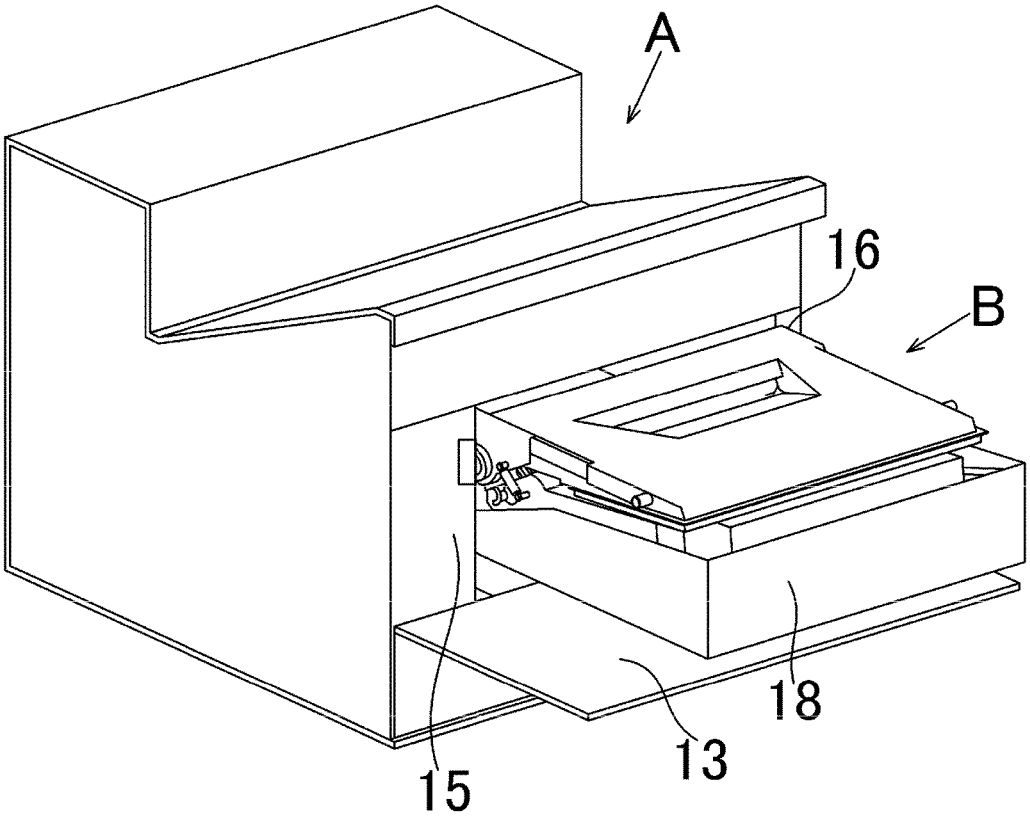
FIG. 6 is a diagram illustrating a state in which a tray is drawn from the apparatus body of the image forming apparatus according to the first embodiment.
Figure 7:
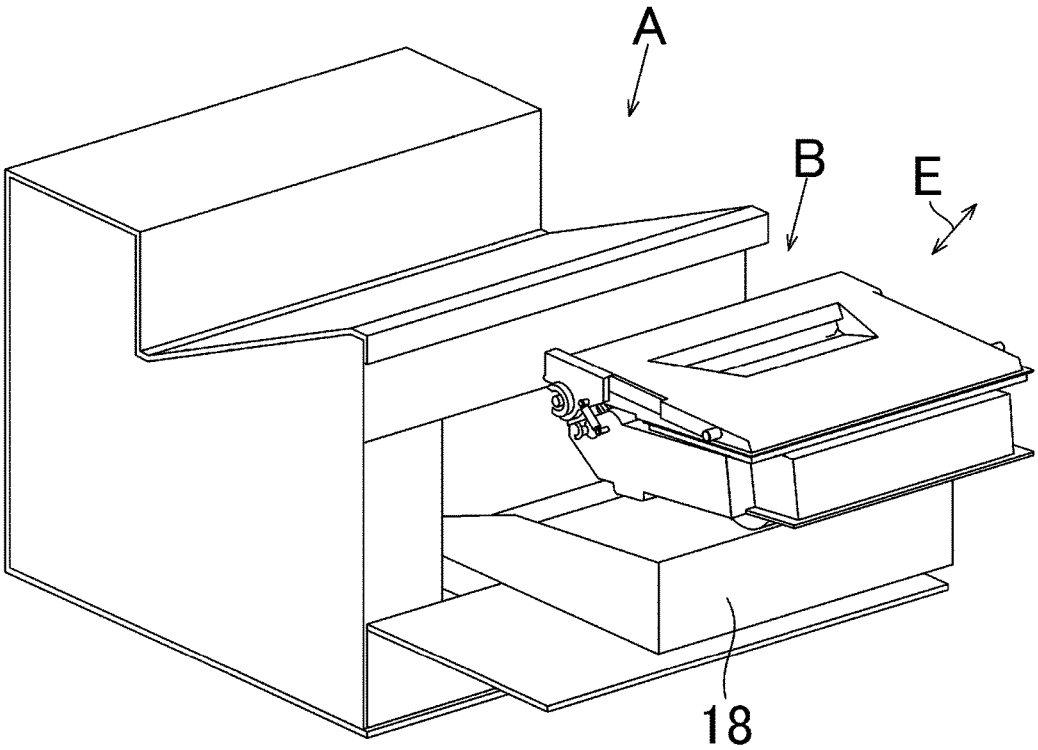
FIG. 7 is a diagram illustrating a state in which the cartridge is attached to or detached from the tray according to the first embodiment.

Next, attachment and detachment of the cartridge B to and from the apparatus body A will be described with reference to FIGS. 5 to 8. FIG. 5 is a diagram illustrating an open state of an opening door 13 of the apparatus body A of the image forming apparatus S according to the first embodiment. FIG. 6 is a diagram illustrating a state in which the tray 18 is drawn from the apparatus body A of the image forming apparatus S according to the first embodiment. FIG. 7 is a diagram illustrating a state in which the cartridge B is attached to and detached from the tray 18 according to the first embodiment. Here, the cartridge B can be attached to and detached from the tray 18 along an attachment and detachment direction E.

The opening door 13 is pivotably attached to the apparatus body A, and a cartridge insertion opening 17 is exposed when the opening door 13 is open. The tray 18 for attaching the cartridge B to the apparatus body A is provided in the cartridge insertion opening 17. When the tray 18 is drawn up to a predetermined position, the cartridge B can be detached from and attached to the tray 18. Moreover, the cartridge B is attached to the apparatus body A while being guided by a guide rail (not illustrated) in a state of being mounted on the tray 18.

Figure 8:
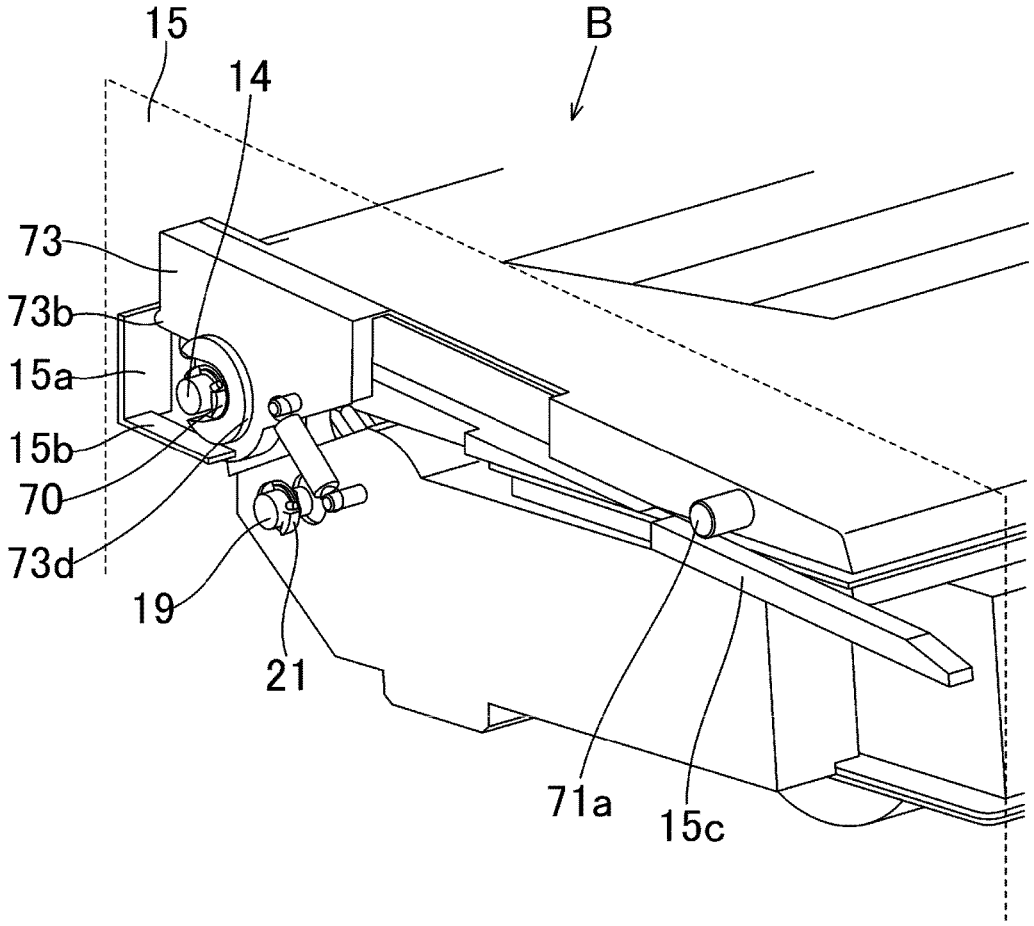
FIG. 8 is a perspective view of the cartridge according to the first embodiment when seen from a driving-side board side.

As illustrated in FIG. 8, a first drive shaft 14 and a second drive shaft 19 for respectively transmitting driving force to a first coupling 70 and a second coupling 21 provided in the cartridge B are formed in the apparatus body A. The first and second drive shafts 14 and 19 are driven by a motor (not illustrated) provided in the apparatus body A. In this way, the drum 62 coupled to the first coupling 70 rotates in response to the driving force from the apparatus body A. Moreover, the developing roller 32 rotates when driving force is transmitted from the second coupling 21. Furthermore, a power feeding unit (not illustrated) of the apparatus body A feeds electric power to the charging roller 66 and the developing roller 32.

<Configuration for Supporting Cartridge B>

Figure 9:
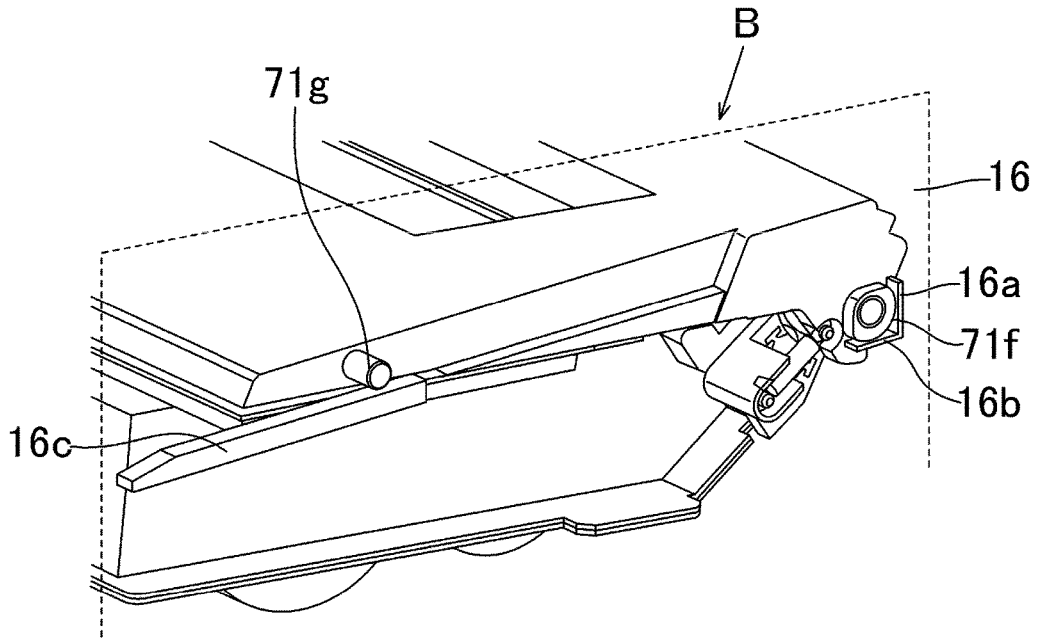
FIG. 9 is a perspective view of the cartridge according to the first embodiment when seen from a non-driving-side board.

As illustrated in FIG. 5, a driving-side board 15 and a non-driving-side board 16 for supporting the cartridge B are provided in the apparatus body A. Here, FIG. 8 is a diagram illustrating a side of the cartridge B according to the first embodiment, which is supported by the driving-side board 15. FIG. 9 is a diagram illustrating a side of the cartridge B according to the first embodiment, which is supported by the non-driving-side board 16. As illustrated in FIG. 8, a first driving-side supporting portion 15*a*, a second driving-side supporting portion 15*b*, and a rotation supporting portion 15*c* of the cartridge B are provided in the driving-side board 15. Moreover, as illustrated in FIG. 9, a first non-driving-side supporting portion 16*a*, a second non-driving-side supporting portion 16*b*, and a rotation supporting portion 16*c* are provided in the non-driving-side board 16.

On the other hand, a supported portion 73*b* and a supported portion 73*d* of a drum bearing 73 are provided in the cartridge B, and a driving-side boss 71*a*, a non-driving-side protrusion 71*f*, and a non-driving-side boss 71*g* of the cleaning frame 71 are provided. The supported portion 73*b* is supported by the first driving-side supporting portion 15*a*, the supported portion 73*d* is supported by the second driving-side supporting portion 15*b*, and the driving-side boss 71*a* is supported by the rotation supporting portion 15*c*. Moreover, the non-driving-side protrusion 71*f* is supported by the first and second non-driving-side supporting portions 16*a* and 16*b*, and the non-driving-side boss 71*g* is supported by the rotation supporting portion 16*c*, whereby the cartridge B is positioned within the apparatus body A.

<Overall Configuration of Cartridge B>

Figure 10:
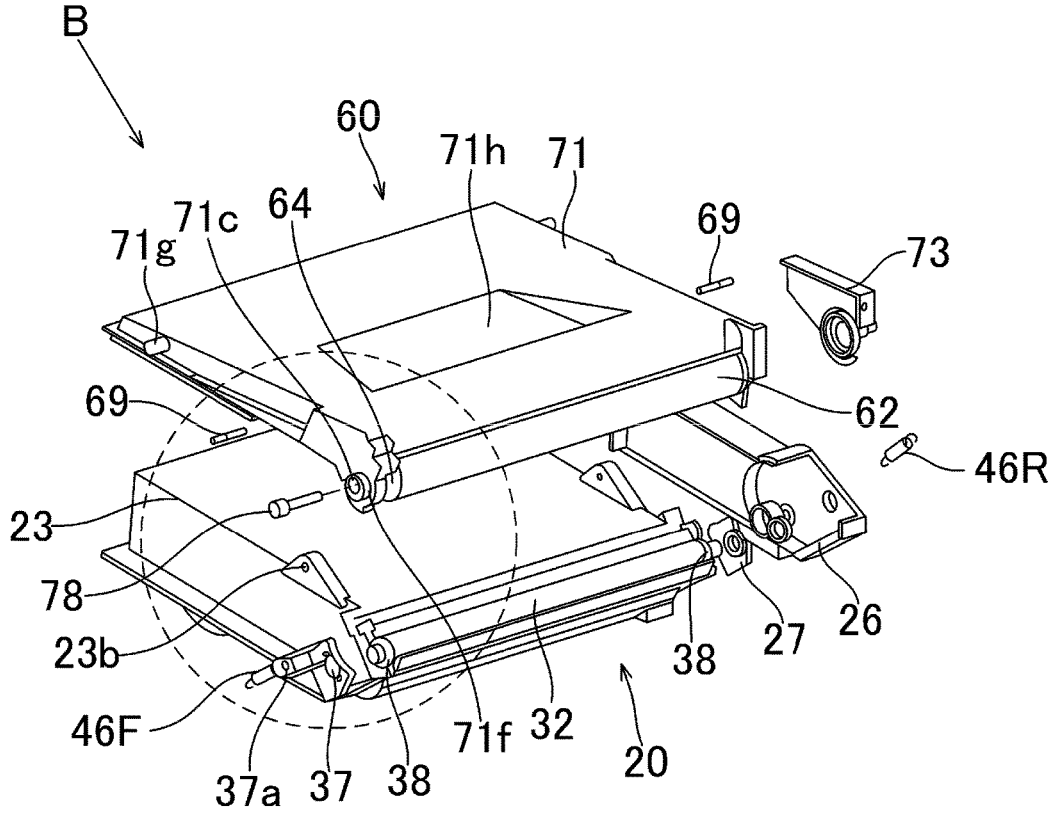
FIG. 10 is an exploded view of the cartridge according to the first embodiment.
Figure 11:
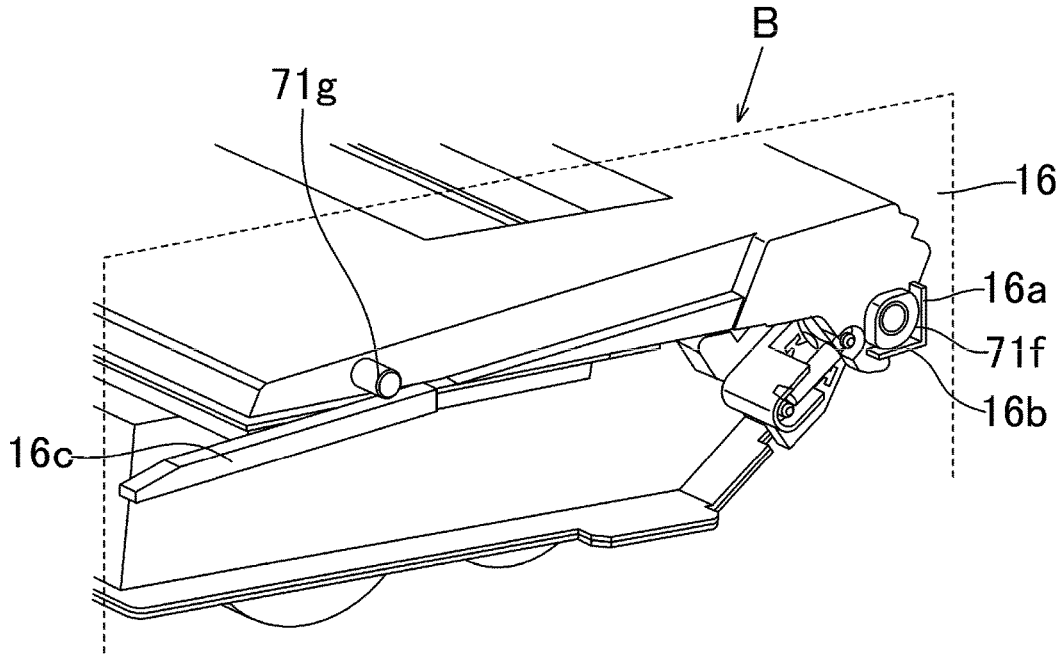
FIG. 11 is a perspective view of the cartridge according to the first embodiment.
Figure 12:
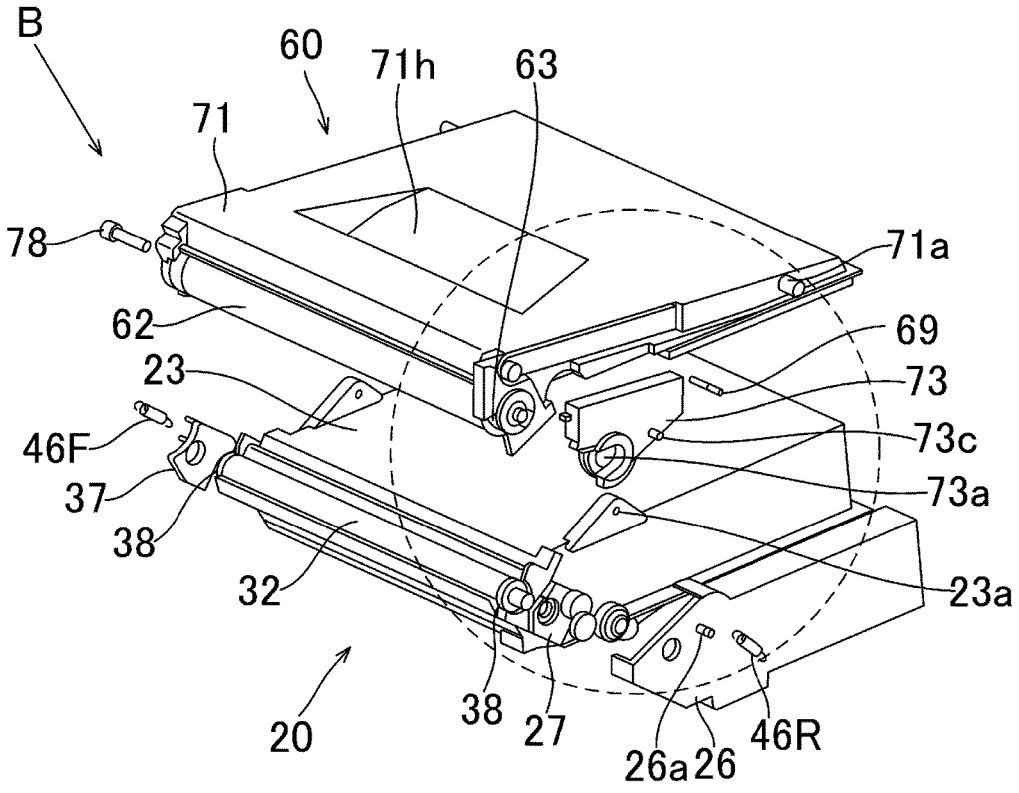
FIG. 12 is an exploded view of the cartridge according to the first embodiment.
Figure 13:
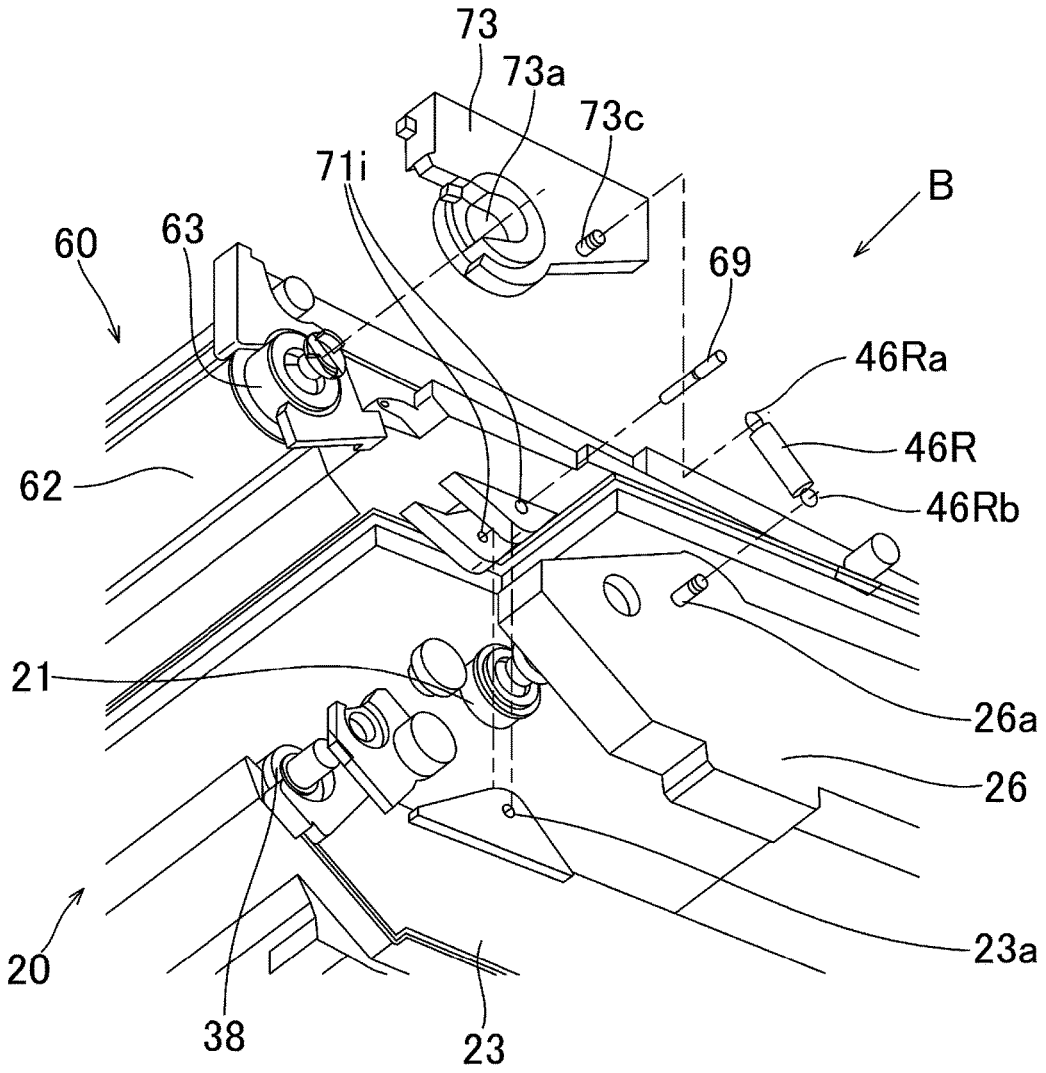
FIG. 13 is an exploded view of the cartridge according to the first embodiment.

Next, an overall configuration of the cartridge B will be described with reference to FIGS. 3, 4, 10, 11, 12, and 13. Here, FIG. 10 is an exploded view of the cartridge B according to the first embodiment. FIG. 11 is a perspective view of the cartridge B according to the first embodiment. FIG. 12 is an exploded view of the cartridge B according to the first embodiment. FIG. 13 is an exploded view of the cartridge B according to the first embodiment. FIGS. 11 and 13 are enlarged views of portions surrounded by dot lines in FIGS. 10 and 12 when seen at different angles. In the present embodiment, the description of screws used when coupling respective components of the cartridge B will be omitted.

As illustrated in FIGS. 3 and 10, the cartridge B includes a cleaning unit 60 and a developing unit 20. The cartridge B has a configuration in which the drum 62 and at least one of the charging roller 66, the developing unit 20, and the cleaning unit 60 as the process mechanisms that act on the drum 62 are integrated with each other as a cartridge. Moreover, the cartridge B is detachably attached to the apparatus body A of the image forming apparatus S. In the present embodiment, the cartridge B includes at least the cleaning unit 60.

The cleaning unit 60 has the drum 62, the charging roller 66, the cleaning member 77, and a cleaning frame 71 that supports these components, and a lid member 72 fixed to the cleaning frame 71 by welding or the like. In the cleaning unit 60, the charging roller 66 and the cleaning member 77 are in contact with the outer circumferential surface of the drum 62.

The cleaning member 77 has a rubber blade 77*a* which is a blade-shaped elastic member formed of rubber as an elastic material and a supporting member 77*b* that supports the rubber blade. The rubber blade 77*a* is in contact with the drum 62 in a counter direction in relation to the rotation direction of the drum 62. That is, the rubber blade 77*a* is in contact with the drum 62 so that the distal end of the rubber blade 77*a* faces the upstream side in the rotation direction of the drum 62.

Figure 4:
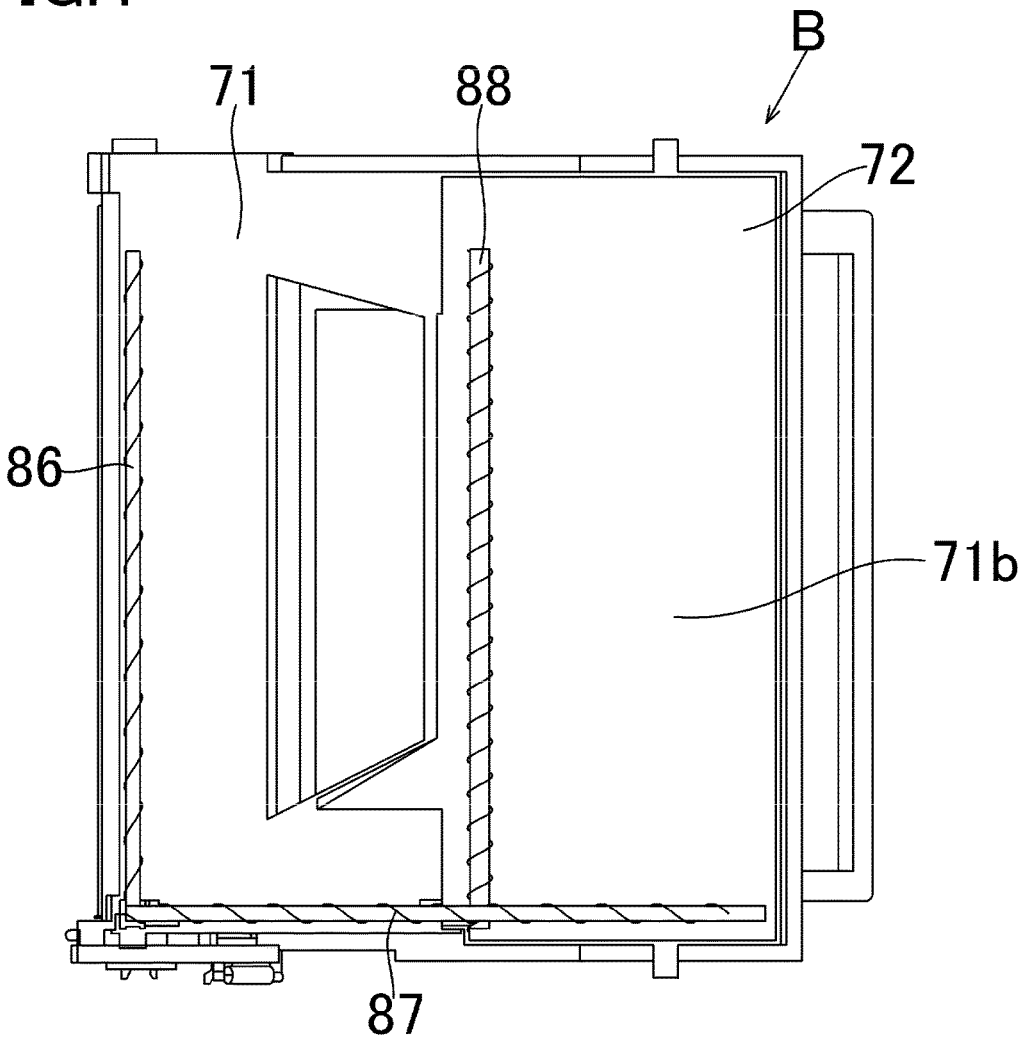
FIG. 4 is a cross-sectional view of a cleaning frame of the cartridge according to the first embodiment.
Figure 4:
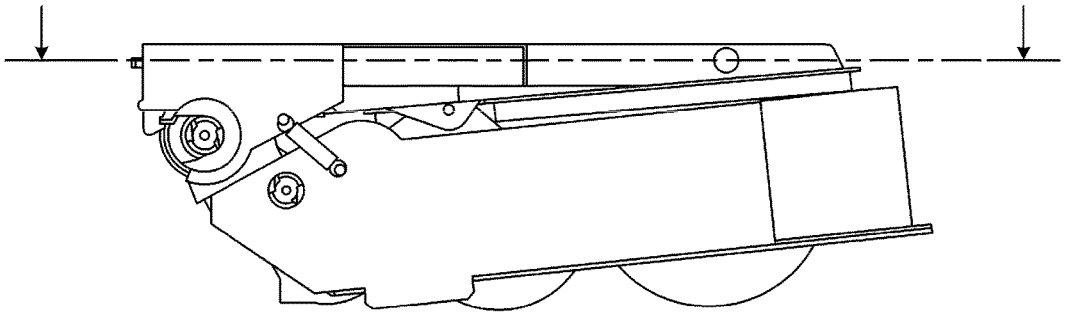

As illustrated in FIGS. 3 and 4, waste toner removed from the surface of the drum 62 by the cleaning member 77 is conveyed by a first screw 86, a second screw 87, and a third screw 88 as a waste toner conveying member. The waste toner is accumulated in a waste toner chamber 71*b* formed by the cleaning frame 71 and the lid member 72. Moreover, the first screw 86 rotates in response to driving force transmitted from the coupling 21 illustrated in FIG. 13 via a gear (not illustrated). The second screw 87 rotates in response to driving force transmitted from the first screw 86, and the third screw 88 rotates in response to driving force transmitted from the second screw 87.

The first screw 86 is disposed near the drum 62, the second screw 87 is disposed at the end in the longitudinal direction of the cleaning frame 71, and the third screw 88 is disposed in the waste toner chamber 71*b*. Here, the axes of the center of rotation of the first and third screws 86 and 88 are parallel to the axis of the center of rotation of the drum 62, and the axis of the center of rotation of the second screw 87 is orthogonal to the axis of the center of rotation of the drum 62. As illustrated in FIG. 3, a scooping sheet 65 for preventing leakage of waste toner from the cleaning frame 71 is provided at an edge of the cleaning frame 71 so as to make contact with the drum 62.

The drum 62 rotates in the direction indicated by arrow R according to an image forming operation in response to driving force from a body driving motor (not illustrated) which is a driving source. Moreover, the charging roller 66 is rotatably attached to the cleaning unit 60 with the aid of a charging roller bearing 67 at both ends in the longitudinal direction (approximately parallel to the axial direction of the center of rotation of the drum 62) of the cleaning frame 71. The charging roller 66 is configured such that the charging roller bearing 67 is pressed toward the drum 62 by the biasing member 68. In this way, the charging roller 66 presses the drum 62. The charging roller 66 rotates following the rotation of the drum 62.

As illustrated in FIG. 3, the developing unit 20 has the developing roller 32, a developing container 23 that supports the developing roller 32, a developing blade 42, and the like. A magnet roller 34 is provided in the developing roller 32. Moreover, a developing blade 42 for regulating a toner layer on the developing roller 32 is disposed in the developing unit 20. As illustrated in FIGS. 10 and 12, an interval holding member 38 is attached to both ends of the developing roller 32 and the interval holding member 38 is in contact with the drum 62, whereby a small gap is formed between the developing roller 32 and the drum 62.

As illustrated in FIG. 3, a blowout preventing sheet 33 for preventing leakage of toner from the developing unit 20 is provided at an edge of a bottom member 22 so as to make contact with the developing roller 32. Furthermore, a first conveying member 43, a second conveying member 44, and a third conveying member 50 are provided in the toner chamber 29 formed by the developing container 23 and the bottom member 22. The first, second, and third conveying members 43, 44, and 50 stir the toner stored in the toner chamber 29 and convey the toner to the toner supply chamber 28.

As illustrated in FIGS. 10 and 11, the cartridge B is formed by combining the cleaning unit 60 and the developing unit 20. The cleaning frame 71, the lid member 72, the drum 62, a drum bearing 73 for rotatably supporting the drum 62, and a drum shaft 78 are provided in the cleaning unit 60. As illustrated in FIG. 13, on the side of the driving-side board 15, the drum 62 is rotatably supported when a driving-side drum flange 63 provided on the side of the driving-side board 15 is fitted to a hole 73*a* of the drum bearing 73. On the other hand, as illustrated in FIG. 10, on the side of the non-driving-side board 16, the drum shaft 78 press-fitted to a hole 71*c* formed in the cleaning frame 71 rotatably supports the hole (not illustrated) of a non-driving-side drum flange 64.

As illustrated in FIGS. 3, 10, and 12, the developing unit 20 includes the bottom member 22, the developing container 23, a driving-side developing side member 26, the developing blade 42, the developing roller 32, and the like. The developing roller 32 is rotatably supported by a bearing member 27 and a bearing member 37 provided at both ends of the developing roller 32. As illustrated in FIGS. 11 and 13, the cleaning unit 60 and the developing unit 20 are pivotably coupled by a coupling pin 69, whereby the cartridge B is formed.

Specifically, as illustrated in FIGS. 10 and 12, a first developing support hole 23*a* and a second developing support hole 23*b* are formed in the developing container 23 at both ends in the longitudinal direction of the developing unit 20. As illustrated in FIGS. 10, 12, and 13, a first suspension hole 71*i* and a second suspension hole (not illustrated) are formed in the cleaning frame 71 at both ends in the longitudinal direction of the cleaning unit 60. The coupling pins 69 press-fitted to the first suspension hole 71*i* and the second suspension hole (not illustrated) are fitted to the first and second developing support holes 23*a* and 23*b* whereby the cleaning unit 60 and the developing unit 20 are coupled in a pivotable manner.

As illustrated in FIG. 13, a first hole 46Ra of a driving-side biasing member 46R is caught at a boss 73*c* of the drum bearing 73, and a second hole 46Rb is caught at a boss 26*a* of the driving-side developing side member 26. As illustrated in FIGS. 10 and 12, a first hole (not illustrated) of a non-driving-side biasing member 46F is caught at a boss (not illustrated) of the cleaning frame 71, and a second hole (not illustrated) of the biasing member 46F is caught at a boss 37*a* of the bearing member 37.

In the present embodiment, the driving-side biasing member 46R and the non-driving-side biasing member 46F are formed of a tension spring, and the developing unit 20 is biased toward the cleaning unit 60 by the biasing force of the spring. In this way, the developing roller 32 is reliably pressed toward the drum 62. Moreover, a predetermined interval is formed between the developing roller 32 and the drum 62 by the interval holding member 38 attached to both ends of the developing roller 32.

<Configuration of Bearing Member 37>

Figure 14A:
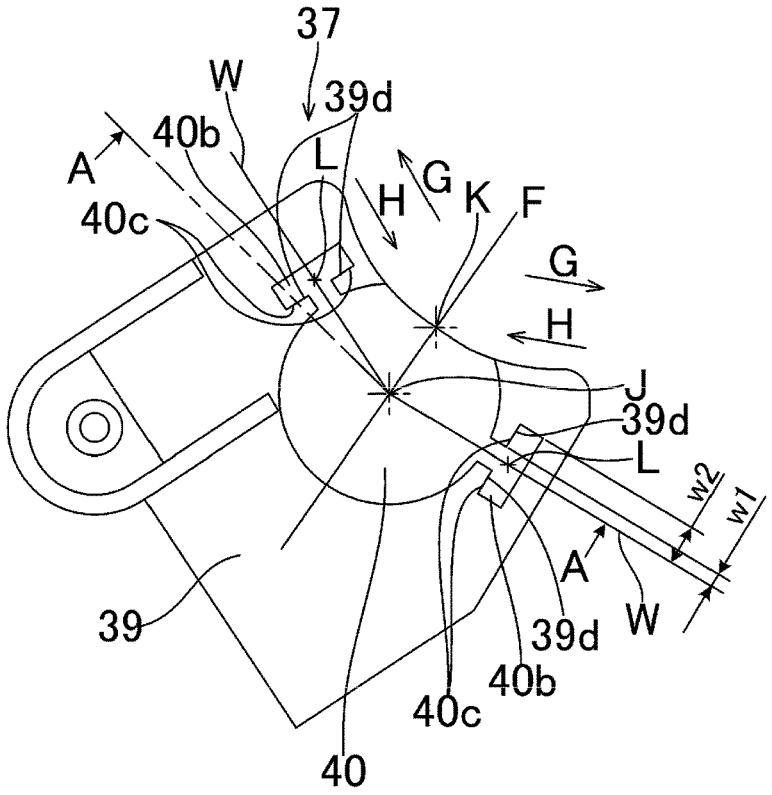
FIGS. 14A and 14B are external views illustrating a first supporting member and a second supporting member according to the first embodiment.
Figure 14B:
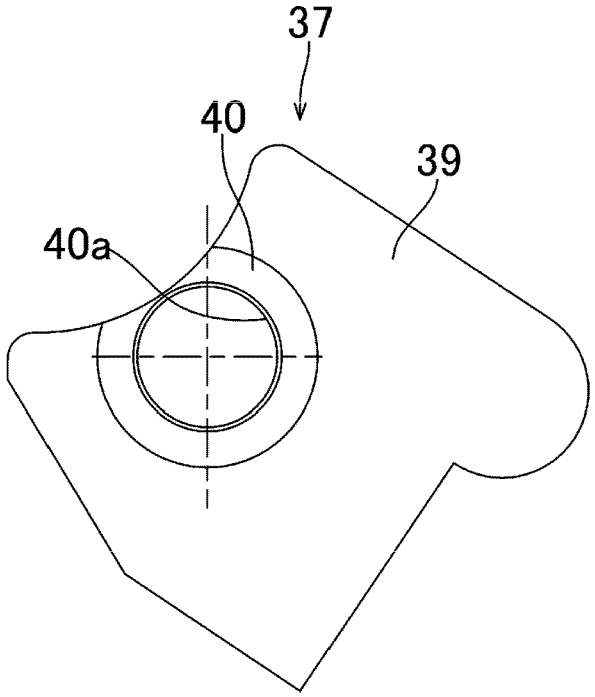
Figure 15A:
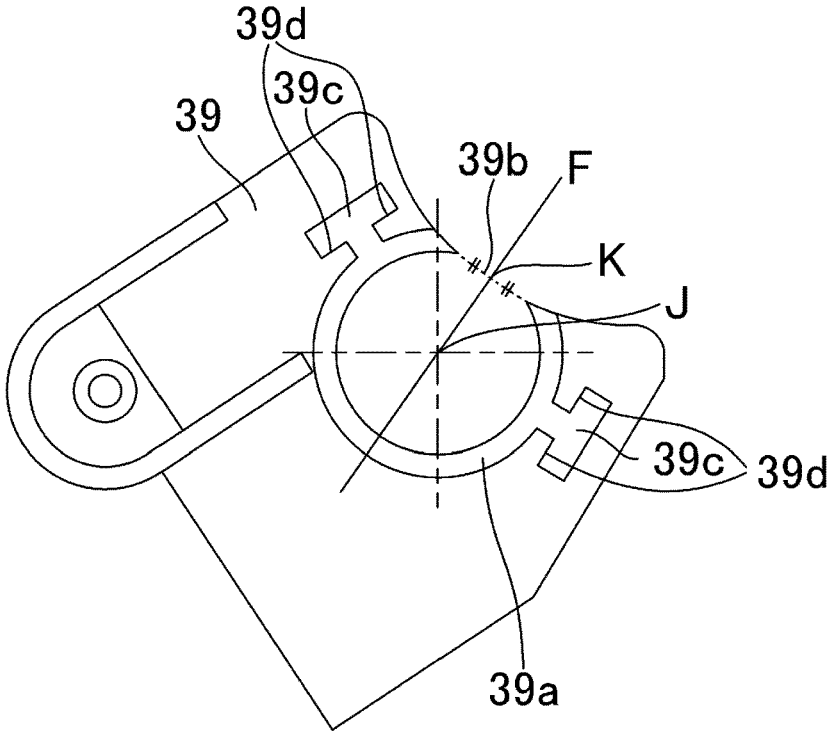
FIGS. 15A and 15B are diagrams illustrating the second supporting member according to the first embodiment.
Figure 15B:
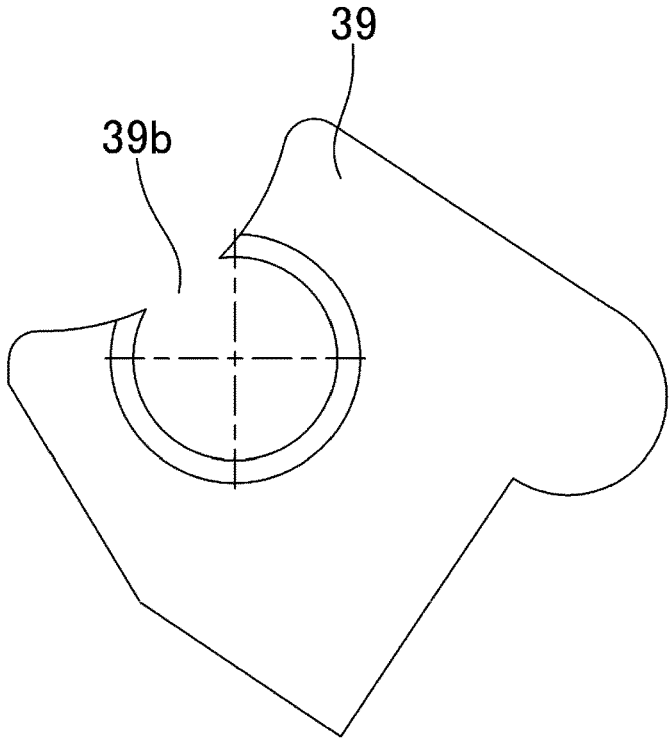
Figure 16A:
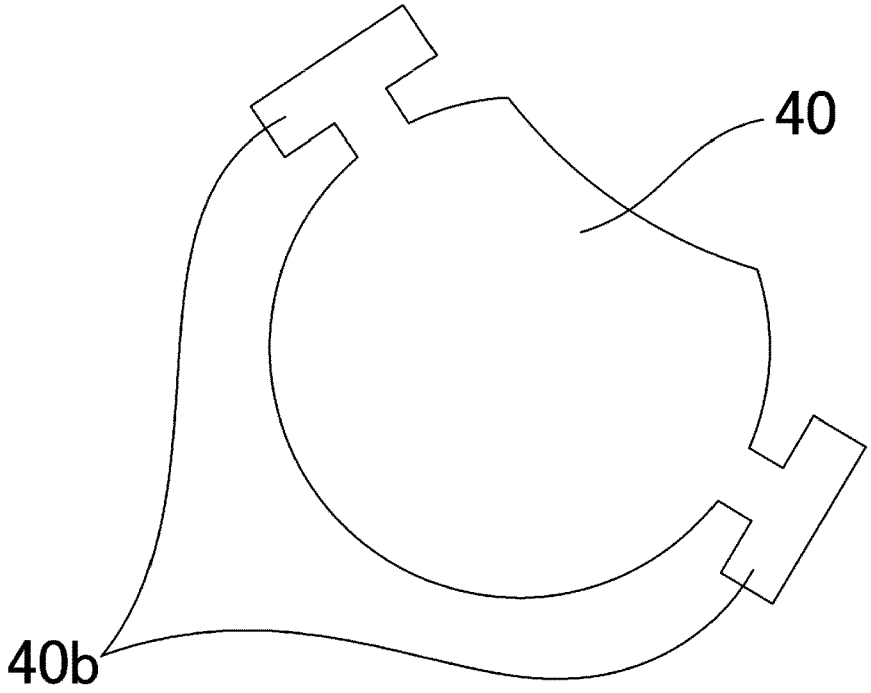
FIGS. 16A and 16B are diagrams illustrating the first supporting members according to the first embodiment.
Figure 16B:
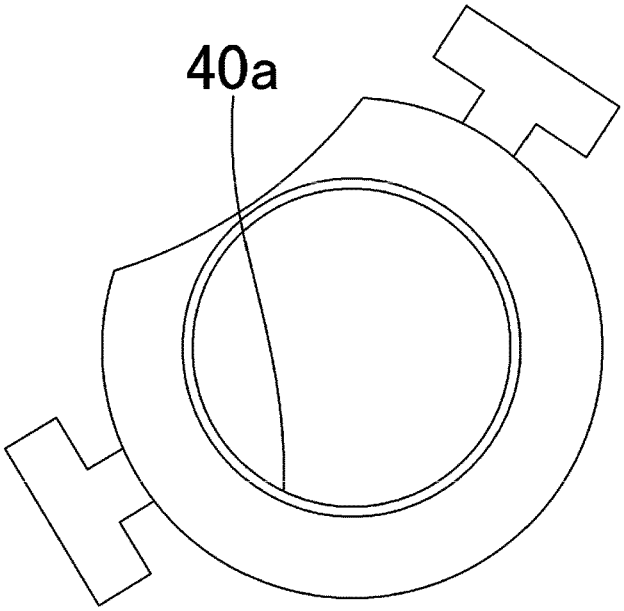

Next, the bearing member 37 that supports the developing roller 32 of the cartridge B according to the present embodiment will be described with reference to FIGS. 14A and 14B, 15A and 15B, and 16A and 16B. FIGS. 14A and 14B are external views illustrating the bearing member 37 according to the first embodiment. FIGS. 15A and 15B are diagrams illustrating a first resin portion 39 as the second supporting member according to the first embodiment. FIGS. 16A and 16B are diagrams illustrating a second resin portion 40 as the first supporting member according to the first embodiment. The first and second resin portions 39 and 40 are formed of different materials, the second resin portion 40 is formed of a conductive resin, and current flows through the developing roller 32 via the second resin portion 40 having a conductivity. Moreover, the material that forms the first resin portion 39 is cheaper than the material that forms the second resin portion 40.

FIG. 14A is a view when the bearing member 37 is seen from the non-driving-side board 16 and FIG. 14B is a view when the bearing member 37 is seen from the opposite direction from FIG. 14A. As illustrated in FIG. 14A, the bearing member 37 that rotatably supports the developing roller 32 includes the first resin portion 39 as a supporting member and the second resin portion 40 as a pivotably support member. As illustrated in FIGS. 15A and 15B, a holding portion 39*a*, an opening 39*b*, and a latched portion 39*c* (corresponding to a first engaged portion and a second engaged portion) are formed in the first resin portion 39. The opening 39*b* is a gap formed so that the inner wall of the penetration portion formed in the first resin portion 39 is discontinuous. In this manner, in the direction crossing the axial direction of the center of rotation of the developing roller 32, the first resin portion 39 is disposed to be adjacent to the second resin portion 40 so as to support the second resin portion 40. On the other hand, the first resin portion 39 has an opening 39*b* that partially exposes the second resin portion 40 (more specifically, a contour of the second resin portion 40).

As illustrated in FIGS. 16A and 16B, a pivotably support portion 40*a* and a latching portion 40*b* (corresponding to a first engaging portion and a second engaging portion) are integrally formed in the second resin portion 40. The second resin portion 40 is attached to the first resin portion 39 by being fitted to the penetration portion formed in the first resin portion 39. Moreover, the latching portion 40*b* extends in a direction orthogonal to a direction in which the second resin portion 40 is fitted to the first resin portion 39. The extension direction of one latching portion 40*b* is opposite to the extension direction of the other latching portion 40*b*.

As illustrated in FIGS. 15A and 15B, a holding portion 39*a* of the first resin portion 39 is arranged around the pivotably support portion 40*a* in a plane orthogonal to the axial direction of the center of rotation of the developing roller 32 so as to support the pivotably support portion 40*a*. The holding portion 39*a* is disposed so as to be parallel to the pivotably support portion 40*a* in the direction crossing the axis of the center of rotation of the developing roller 32 to support the pivotably support portion 40*a*. In addition, the holding portion 39*a* has a convex portion extending in the direction crossing the axis of the center of rotation, and restricts the movement of the pivotably support portion 40*a* along the axis of the center of rotation. More specifically, the holding portion 39*a* has a convex portion extending toward the axis of the center of rotation and the pivotably support portion 40*a* engages with the convex portion to restrict the movement along the axis of the center of rotation. Moreover, the opening 39*b* is formed in the holding portion 39*a* so that the drum 62 can further approach the developing roller 32, and a portion exposed from the opening 39*b* is notched. As illustrated in FIG. 15A, the latched portions 39*c* are provided in respective regions divided by a straight line F that connects the center of rotation J of the developing roller 32 and the midpoint K of the opening 39*b*.

In the present embodiment, the opening 39*b* extends in the rotational direction of the developing roller 32 at a predetermined interval. In a plane orthogonal to the axis of the center of rotation of the developing roller 32, one latched portion 39*c* is provided on one side of the first resin portion 39 in relation to the straight line that connects the axis of the center of rotation of the developing roller 32 and the midpoint of the opening 39*b*. Moreover, the other latched portion 39*c* is provided on the other side of the first resin portion 39 in relation to the straight line that connects the axis of the center of rotation of the developing roller 32 and the midpoint of the opening 39*b*. The latching portion 40*b* applies force to the latched portion 39*c* in the direction opposite to the direction in which the latched portion 39*c* moves when the opening 39*b* opens. More specifically, the latching portion 40*b* applies force to the latched portion 39*c* so that the opening 39*b* is closed when the first resin portion 39 is deformed so that the opening 39*b* opens.

Here, as illustrated in FIG. 14A, W is defined as a straight line that connects the center of rotation J of the developing roller 32 and a centroid L of the latching portion 40*b*. The latching portion 40*b* has a large width portion and a small width portion. The large width portion is positioned away from the small width portion in the direction of the straight line W. Specifically, the center of rotation J, the small width portion, and the large width portion are arranged in that order in the direction of the straight line W, that is, the direction away from the center of rotation J).

Figure 18:
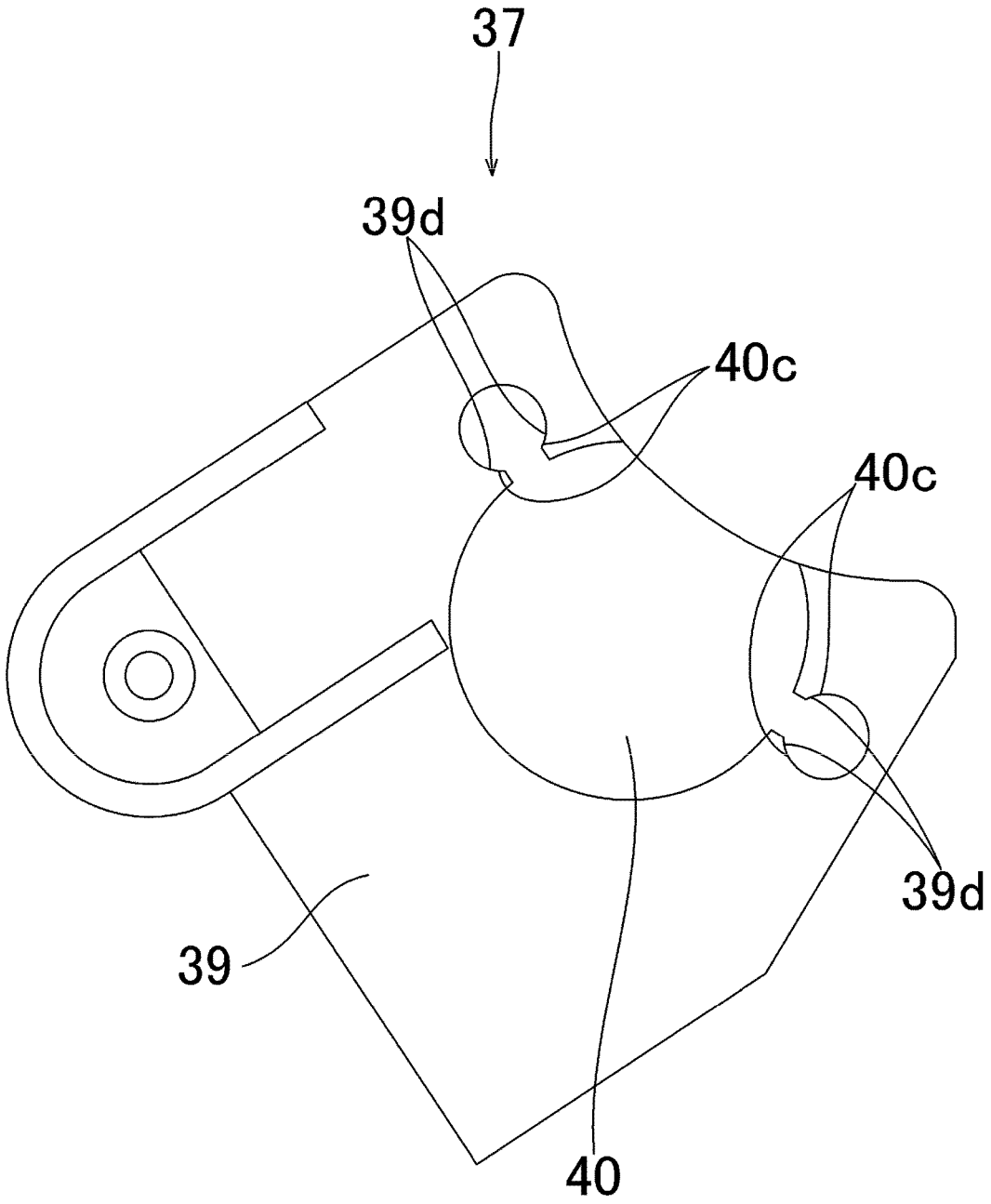
FIG. 18 is a diagram illustrating a modification of the first and second supporting member according to the first embodiment.
Figure 19:
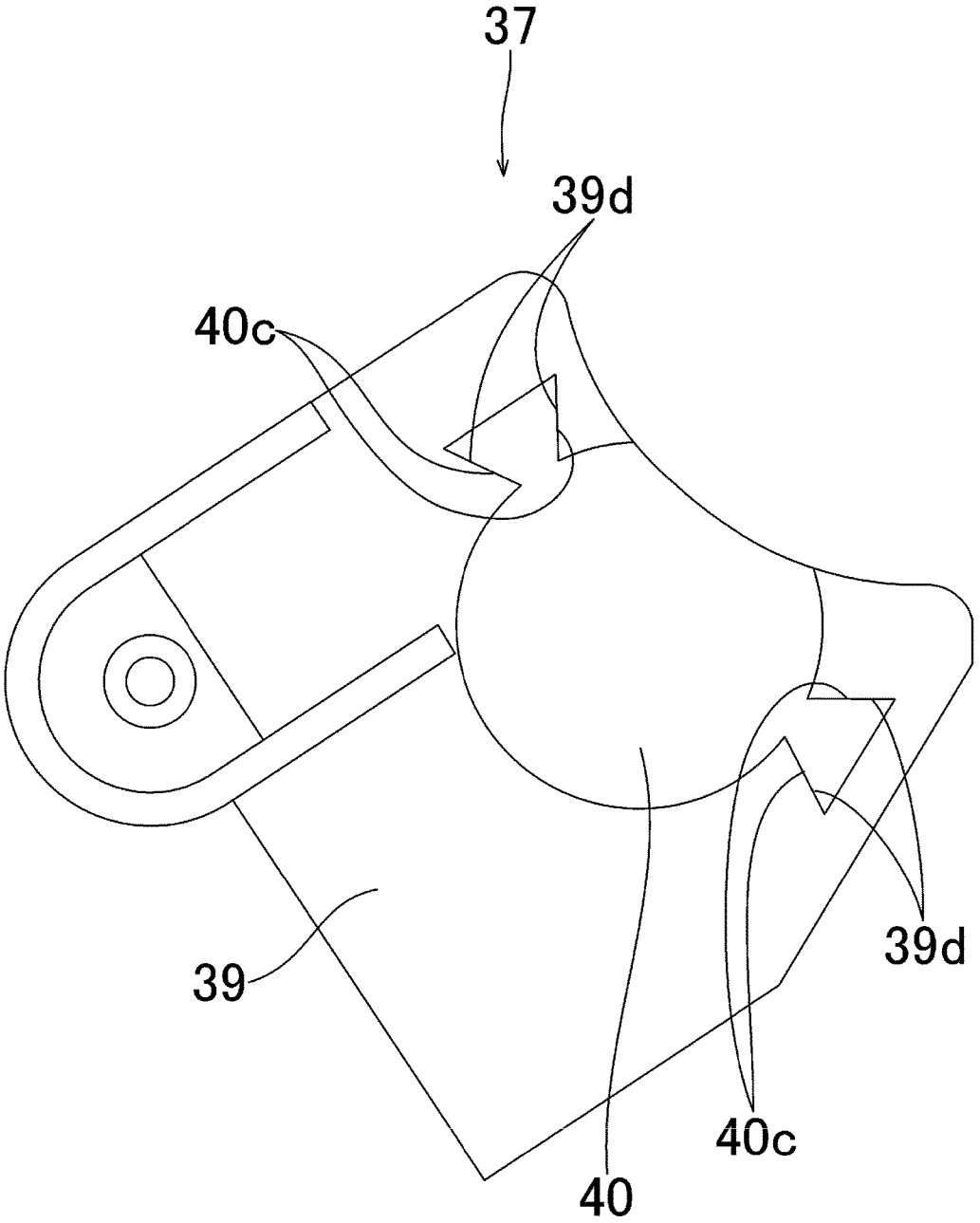
FIG. 19 is a diagram illustrating a modification of the first and second supporting member according to the first embodiment.

A straight line that is parallel to the straight line W and follows an outer shape of the small width portion of the latching portion 40*b* is defined as a straight line w1, and a straight line that follows an outer shape of the large width portion of the latching portion 40*b* is defined as a straight line w2. As illustrated in FIGS. 14A and 14B, the straight line w1 is at the shortest distance from the straight line W among the straight lines that make contact with the outer shape of the latching portion 40*b*. Moreover, the straight line w2 is at the longest distance from the straight line W among the straight lines that make contact with the outer shape of the latching portion 40*b*. A contacted portion 39*d* of the first resin portion 39 and a contact portion 40*c* of the second resin portion 40 are provided in a region sandwiched by the straight lines w1 and w2. The shape of the latching portion 40*b* and the latched portion 39*c* may be circular as illustrated in FIG. 18 and may be triangular as illustrated in FIG. 19, for example. The shape of the latching portion 40*b* and the latched portion 39*c* is not particularly limited as long as the condition (the relation with the straight lines w1 and w2) is satisfied. In the present embodiment, the frictional coefficient of the second resin portion 40 is smaller than the frictional coefficient of the first resin portion 39. Specifically, when the first and second resin portions 39 and 40 have respective portions having the same shape, the frictional coefficient of the second resin portion 40 is smaller than the frictional coefficient of the first resin portion 39 in the portion having the same shape.

<Steps of Forming Bearing Member 37>

Figure 1A:
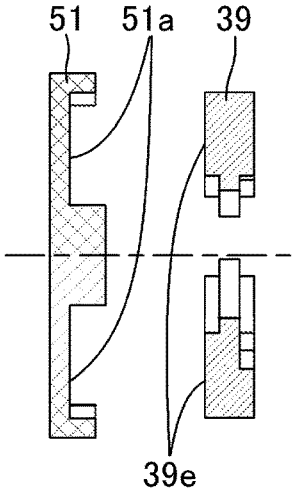
FIGS. 1A to 1E are cross-sectional views illustrating a method for manufacturing a first resin portion according to a first embodiment.

Next, steps of forming the bearing member 37 will be described with reference to FIGS. 1A to 1E. FIGS. 1A to 1E schematically illustrate cross-sections taken along line A-A in FIG. 14A. As illustrated in FIG. 1A, when the bearing member 37 is formed, a mold 51 is brought into contact with the first resin portion 39 that is formed using another mold. In this case, a mold contact surface 39*e* of the first resin portion 39 abuts on a contact surface 51*a* of the mold 51.

Figure 1B:
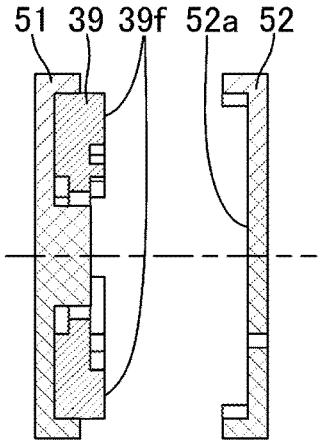
Figure 1C:
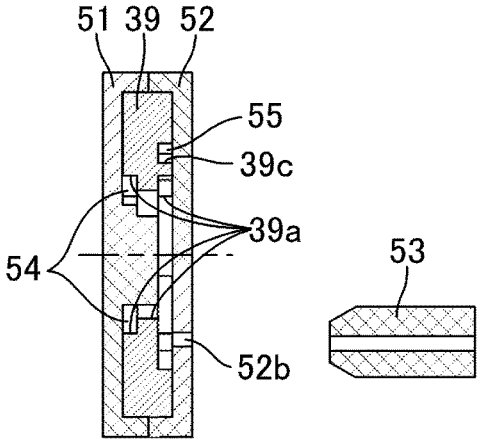

Subsequently, as illustrated in FIG. 1B, the mold 52 is brought into contact with the first resin portion 39. In this case, the mold contact surface 39*f* of the first resin portion 39 abuts on the contact surface 52*a* of the mold 52 contacting the first resin portion 39. FIG. 1C illustrates a state in which the two molds 51 and 52 are brought into contact with the first resin portion 39 so as to sandwich the first resin portion 39. The first resin portion 39 is positioned by the molds 51 and 52 (not illustrated). In this case, the holding portion 39*a* of the first resin portion 39 and the molds 51 and 52 form a pivotably-support-portion-forming space 54. The latched portion 39*c* of the first resin portion 39 is disposed to face the mold 52 with a latching portion-forming space 55 interposed therebetween.

Figure 1D:
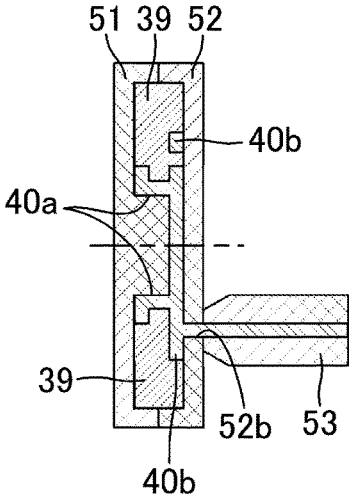

Subsequently, a gate 53 for injecting a second resin is brought into contact with an injection opening 52*b* of the mold 52. The gate 53 and the mold 52 may be initially integrated with each other. After that, as illustrated in FIG. 1D, the second resin enters from the gate 53 into the pivotably support-portion-forming space 54 and the latching portion-forming space 55 through the injection opening 52*b*, whereby the pivotably support portion 40*a* and the latching portion 40*b* which form the second resin portion 40 are formed.

Figure 1E:
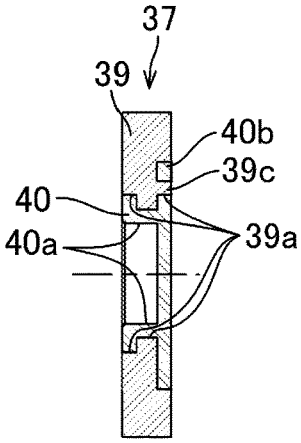

When injection of the second resin is completed, the molds 51 and 52 are separated from the bearing member 37. Separation of the molds 51 and 52 is performed in the order reverse to the order of attaching the molds 51 and 52 to the first resin portion 39. First, the gate 53 is retracted from the injection opening 52*b* of the mold 52. Subsequently, the mold 52 is released from the first and second resin portions 39 and 40, and finally, the mold 51 is released from the first and second resin portions 39 and 40. In this way, as illustrated in FIG. 1E, the bearing member 37 in which the first and second resin portions 39 and 40 are integrally formed is formed.

The second resin portion formed in this manner is thermally contracted after being formed. Specifically, the second resin solidifies and the second resin portion 40 is thermally contracted whereby the latching portion 40*b* applies force to the latched portion 39*c* in the direction in which the opening 39*b* is closed. Due to this, as illustrated in FIG. 14A, the contact portion 40*c* formed in the latching portion 40*b* of the second resin portion 40 is contracted in the direction indicated by arrow H. Moreover, since the contact portion 40*c* is in contact with the contacted portion 39*d* of the first resin portion 39, the contacted portion 39*d* is pressed by the contact portion 40*c* in the direction indicated by arrow H. In this way, since it is possible to suppress the opening 39*b* of the first resin portion 39 from opening in the direction indicated by arrow G, the positional accuracy of the holding portion 39*a* of the first resin portion 39 becomes stable. Due to this, the positional accuracy of the pivotably support portion 40*a* of the second resin portion 40 becomes stable. In the present embodiment, functions, materials, shapes, relative positions, and the like of constituent components are examples only, and unless otherwise specified, the scope of this invention is not to be limited thereto.

As described above, in the present embodiment, the latching portion 40*b* applies force to the latched portion 39*c* in the direction opposite to the direction in which the latched portion 39*c* moves when the opening 39*b* opens. Due to this, it is possible to suppress the opening 39*b* from opening and to suppress the second resin portion 40 from being separated from the first resin portion 39. That is, the second resin portion 40 that supports the developing roller 32 can be positioned with high accuracy in relation to the first resin portion 39 that supports the second resin portion 40.

In the present embodiment, the material that forms the first resin portion 39 is cheaper than the material that forms the second resin portion 40. Due to this, it is possible to reduce the manufacturing cost of the image forming apparatus S further than when the first and second resin portions 39 and 40 are manufactured using the material that forms the second resin portion 40.

In the present embodiment, a molten resin solidifies and the second resin portion 40 is thermally contracted whereby the latching portion 40*b* applies force to the latched portion 39*c* in the direction in which the opening 39*b* is closed. In this way, since it is possible to suppress the opening 39*b* of the first resin portion 39 from opening, it is possible to suppress the second resin portion 40 from being separated from the first resin portion 39.

Second Embodiment

Next, steps of forming the bearing member 37 that supports the developing roller 32 of the cartridge B according to a second embodiment will be described with reference to FIGS. 17A to 17E. Here, in the present embodiment, portions having the same functions as those of the first embodiment will be denoted by the same reference numerals and the description thereof will be omitted. The bearing member 37 according to the present embodiment has the same shape as the bearing member 37 according to the first embodiment.

Figure 17A:
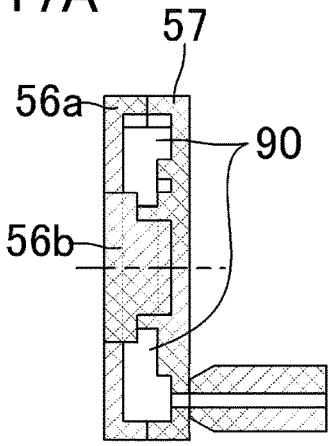
FIGS. 17A to 17E are cross-sectional views illustrating a method for manufacturing a first supporting member according to a second embodiment.
Figure 17D:
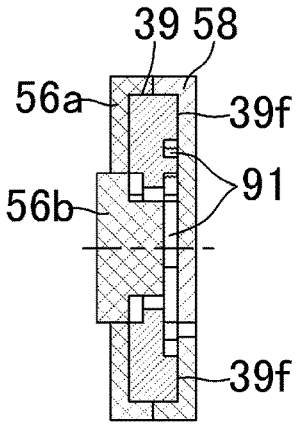
Figure 17B:
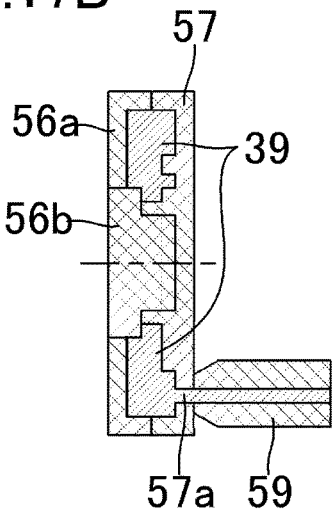

As illustrated in FIG. 17A, molds 56*a*, 56*b*, and 57 are brought into contact with each other to form a first resin-portion-forming space 90. Subsequently, as illustrated in FIG. 17B, a gate 59 is brought into contact with an injection opening 57*a* of the mold 57. In this case, the mold 57 and the gate 59 may be initially integrated with each other. The first resin is injected from the gate 59 into the first resin-portion-forming space 90 whereby the first resin portion 39 is formed.

Figure 17E:
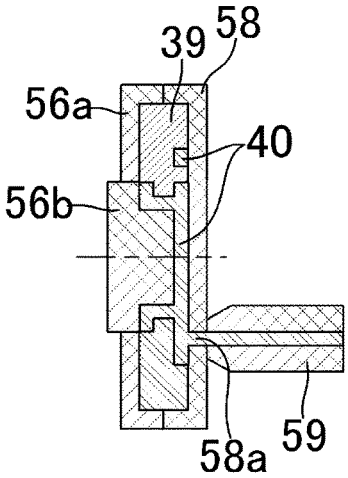
Figure 17C:
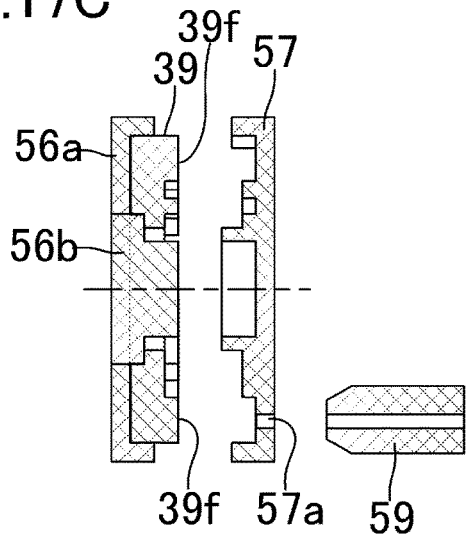

Subsequently, as illustrated in FIG. 17C, the gate 59 is retracted from the injection opening 57*a*, and the mold 57 is released from the molds 56*a* and 56*b* and the first resin portion 39. After that, as illustrated in FIG. 17D, the mold 56*b* is retracted by a distance corresponding to the thickness of the second resin portion 40, and a mold 58 is brought into contact with a mold contact surface 39*f*. In this way, the mold 56*a*, 56*b*, and 58 and the first resin portion 39 form a second resin-portion-forming space 91.

Subsequently, as illustrated in FIG. 17E, the gate 92 is brought into contact with the injection opening 58*a* of the mold 58, and the second resin is injected from the gate 92 into the second resin-portion-forming space 91. In this way, the second resin portion 40 is formed. After injection of the second resin is completed, the molds 56*a*, 56*b*, and 58 are separated from the bearing member 37. Specifically, first, the gate 92 is retracted from the injection opening 58*a* of the mold 58. Subsequently, the mold 58 is released from the first and second resin portions 39 and 40. Finally, the molds 56*a* and 56*b* are released from the first and second resin portions 39 and 40. In this manner, forming of the bearing member 37 is completed. Using such a forming method, it is possible to enhance the injection pressure when injecting a resin into a mold. Due to this, it is possible to maintain the position of the pivotably support portion 40*a* of the second resin portion 40 with higher accuracy.

Third Embodiment

Next, a third embodiment will be described with reference to FIG. 20. In the present embodiment, a bearing member 237 formed using two different types of resin materials will be described. Here, in the present embodiment, portions having the same functions as those of the first embodiment will be denoted by the same reference numerals, and the description thereof will be omitted. In the present embodiment, constituent components different from those of the first embodiment will be described mainly.

Figure 20:
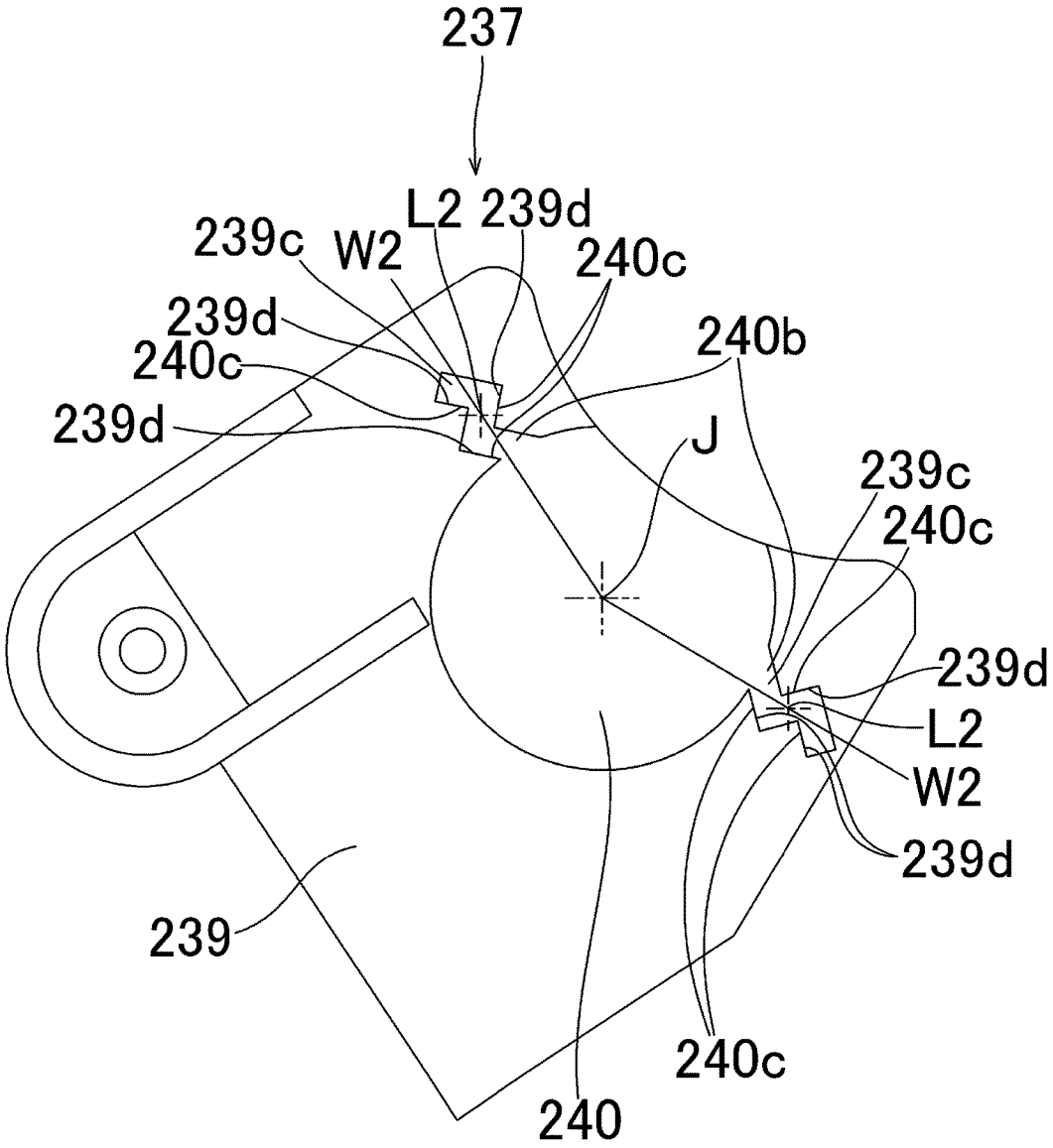
FIG. 20 is a diagram illustrating a first supporting member according to a third embodiment.

FIG. 20 is a diagram illustrating a bearing member 237 according to the third embodiment. In the present embodiment, a latched portion 239*c* of a first resin portion 239 and a latching portion 240*b* of a second resin portion 240 have a wavy shape. Specifically, the latched portion 239*c* and the latching portion 240*b* have a wavy shape in relation to a straight line W2 that connects the center of rotation J of the developing roller 32 and the centroid L2 of the latching portion 240*b*. Using such a shape, it is possible to increase the number of portions of a contacted portion 239*d* of the first resin portion 239 applying force to the contact portion 240*c* of the second resin portion 240. In this way, it is possible to more stably suppress the holding portion 39*a* from opening. Due to this, it is possible to further improve the positional accuracy of the pivotably support portion 40*a*.

Fourth Embodiment

Next, a fourth embodiment will be described with reference to FIG. 21. Here, in the present embodiment, portions having the same functions as those of the first embodiment will be denoted by the same reference numerals and the description thereof will be omitted. In the first embodiment, the contacted portion 39*d* of the first resin portion 39 and the contact portion 40*c* of the second resin portion 40 extend in the direction of the plane orthogonal to the axial direction of the center of rotation of the developing roller 32. In contrast, in the present embodiment, a latched portion 339*c* of a first resin portion 339 and a latching portion 340*b* of a second resin portion 340 extend in the axial direction of the center of rotation of the developing roller 32.

Figure 21:
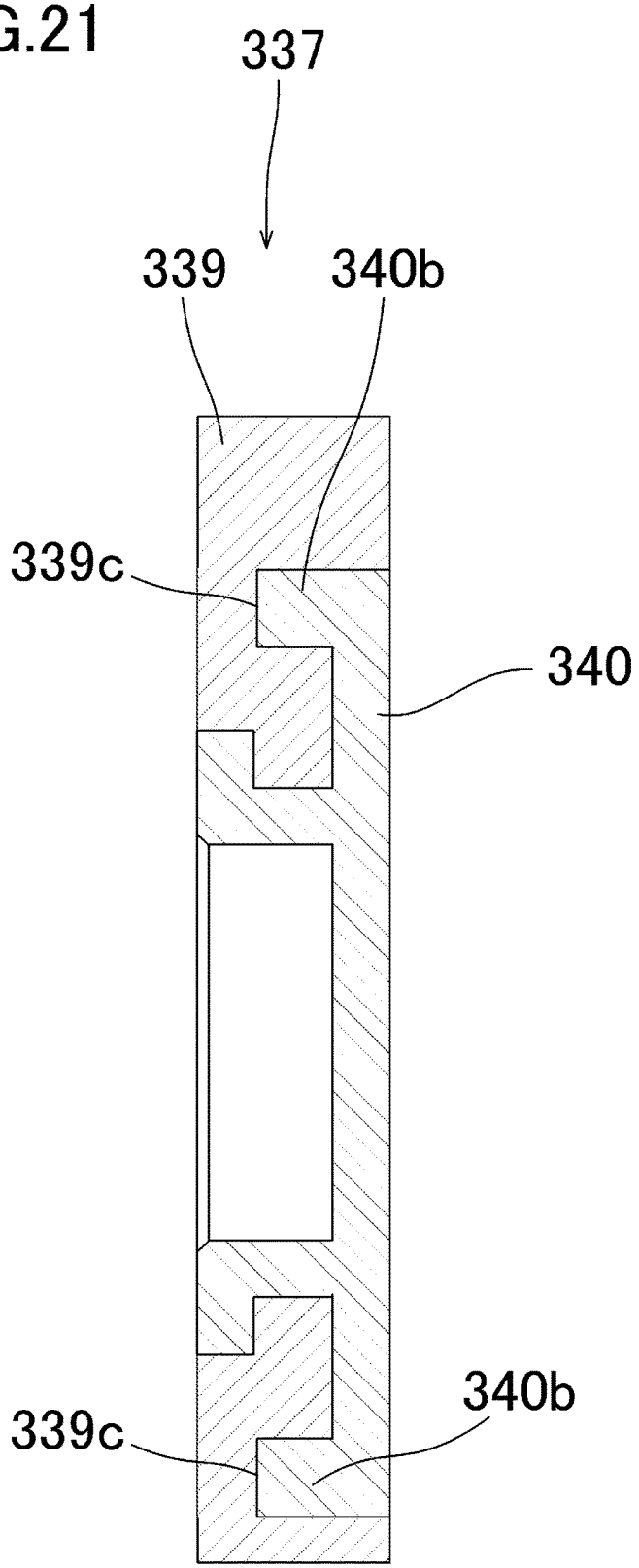
FIG. 21 is a diagram illustrating a first supporting member and a second supporting member according to a fourth embodiment.

FIG. 21 is a diagram illustrating a bearing member 337 according to the fourth embodiment. Specifically, FIG. 21 is a cross-sectional view when the bearing member 337 is cut along a plane parallel to the axial direction of the center of rotation of the developing roller 32. In the present embodiment, the latching portion 340*b* of the second resin portion 340 has a convex shape that protrudes in the axial direction of the center of rotation of the developing roller 32. The first resin portion 339 also has a shape that follows the second resin portion 340. Due to this, since it is not necessary to form the latched portion 339*c* and the latching portion 340*b* to extend along the plane orthogonal to the axis of the center of rotation of the developing roller 32, it is possible to reduce the size of the bearing member 337 in the plane orthogonal to the axis of the center of rotation of the developing roller 32. Moreover, since the size of the bearing member 337 in the plane orthogonal to the axis of the center of rotation of the developing roller 32 is reduced, it is possible to increase the space in the image forming apparatus S.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-118265, filed on Jun. 14, 2016, which is hereby incorporated by reference herein in its entirety.

What is claimed is:

1. A frame of a cartridge that is detachably attached to an apparatus body of an image forming apparatus, the frame comprising:

a bearing having an inner surface, by which a roller is to be rotatably supported, and an outer surface opposite to the inner surface, the bearing having a first engaging portion and a second engaging portion that protrude from the outer surface; and a bearing supporter including a hole into which the bearing is fitted, the hole having a break from which the outer surface is partially exposed, the bearing supporter including a first engaged portion and a second engaged portion that engage with the first engaging portion and the second engaging portion, respectively, wherein the first engaged portion and the second engaged portion are arranged opposite to each other across a virtual straight line crossing both a center of rotation of the roller and a midpoint of the break in a rotating direction of the roller when viewed in an axial direction of the roller.

2. The frame according to claim 1, wherein the first engaging portion includes a first portion and a second portion that is farther from the outer surface of the bearing than the first portion in a direction in which the first engaging portion extends, and wherein in a direction crossing both the direction in which the first engaging portion extends and the axial direction of the roller, the second portion of the first engaging portion has a width larger than the first portion of the first engaging portion.

3. The frame according to claim 1, wherein the first engaging portion includes an extending portion extending in a radial direction of the roller, a first protruding portion that protrudes, from the extending portion, toward one side, and a second protruding portion that protrudes, from the extending portion, toward the other side in a tangential direction of the roller.

4. The frame according to claim 3, wherein the second engaging portion includes a third portion and a fourth portion that is farther form the outer surface of the bearing than the third portion in a direction in which the second engaging portion extends, and wherein, in a direction crossing both the direction in which the second engaging portion extends and the axial direction of the roller, the fourth portion of, the second engaging portion has a width larger than the third portion of the second engaging portion.

5. The frame according to claim 3, wherein the second engaging portion includes a second extending portion extending in the radial direction of the roller, a third protruding portion that protrudes, from the second extending portion, toward one side, and a fourth extending portion that protrudes, from the second extending portion, toward the other side in a tangential direction of the roller.

6. The frame according to claim 1, wherein the roller is a developing roller for developing an electrostatic latent image formed on an image bearing member.

7. A cartridge comprising:

the frame according to claim 1;

the roller; and an image bearing member on which an electrostatic latent image is formed, wherein the roller is a developing roller, and a developer image is formed on the image bearing member by developing the electrostatic latent image formed on the image bearing member by the roller.

8. The frame according to claim 1, wherein the bearing and the bearing supporter are integrally formed by injection-molding.

9. An image forming apparatus comprising:

the frame according to claim 1;

an image bearing member on which an electrostatic latent image is formed; and the roller, wherein the roller is a developer bearing member for bearing a developer, wherein a developer image is formed on the image bearing member by developing the electrostatic latent image formed on the image bearing member by the developer borne on the roller, and wherein an image is formed on the recording medium by transferring, to a recording medium, the developer image formed on the image bearing member.

10. A method for manufacturing a frame of a cartridge that is detachably attached to an apparatus body of an image forming apparatus, the frame including a bearing having an inner surface, by which a roller is to be rotatably supported, and an outer surface opposite to the inner surface, and a bearing supporter including a hole, into which the bearing is fitted, with a break, the bearing supporter including a first engaged portion and a second engaged portion, wherein the first engaged portion and the second engaged portion are arranged opposite to each other across a virtual straight line crossing both a center of rotation of the roller and a midpoint of the break in a rotating direction of the roller when viewed in an axial direction of the roller, the method comprising:

a first step of preparing the bearing supporter;

a second step of bringing a mold into contact with the bearing supporter and injecting a molten resin into a space formed between the bearing supporter and the mold to form the bearing, wherein, in the second step, the bearing is formed so that the outer surface of the bearing is exposed partially from the break of the bearing supporter, and wherein, in the second step, a first engaging portion, which protrudes from the outer surface of the bearing portion and engages with the first engaged portion, is formed of a resin injected into a space formed between the first engaged portion and the mold, and a second engaging portion, which protrudes from the outer surface of the bearing portion and engages with the second engaged portion, is formed of a resin injected into a space formed between the second engaged portion and the mold.

11. The manufacturing method according to claim 10, wherein the mold is a second mold, and the method further comprises:

bringing the bearing supporter into contact with a first mold;

bringing the second mold into contact with the bearing supporter that is brought into contact with the first mold; and injecting a molten resin into a space formed between the bearing supporter and the first and second molds to form the bearing.

12. The manufacturing method according to claim 10, wherein the molten resin is a second molten resin, and the method further comprises:

injecting a first molten resin between a first and second molds to form the bearing supporter;

separating the second mold from the first mold;

bringing a third mold into contact with the bearing supporter and the first mold; and injecting the second molten resin into a space formed between the bearing supporter and the first and third molds to form the bearing.

* * * * *